US007545402B2

(12) United States Patent
Saquib

(10) Patent No.: US 7,545,402 B2
(45) Date of Patent: Jun. 9, 2009

(54) PRINTER THERMAL RESPONSE CALIBRATION SYSTEM

(75) Inventor: Suhail S. Saquib, Shrewsbury, MA (US)

(73) Assignee: Polaroid Corporation, Concord, MA (US)

( * ) Notice: Subject to any disclaimer, the term of this patent is extended or adjusted under 35 U.S.C. 154(b) by 525 days.

(21) Appl. No.: 11/332,530

(22) Filed: Jan. 13, 2006

(65) Prior Publication Data

US 2006/0159502 A1 Jul. 20, 2006

Related U.S. Application Data

(60) Provisional application No. 60/644,066, filed on Jan. 14, 2005.

(51) Int. Cl.
*B41J 2/00* (2006.01)

(52) U.S. Cl. ..... 347/191

(58) Field of Classification Search ..... 347/191, 347/194, 188, 189, 175, 185; 400/120.09, 400/120.1, 120.11, 120.14
See application file for complete search history.

(56) References Cited

U.S. PATENT DOCUMENTS 4,391,535 A 7/1983 Palmer ..... 400/120
6,801,233 B2 10/2004 Bhatt et al. ..... 347/175
6,819,347 B2 11/2004 Saquib et al. ..... 347/194
7,176,953 B2 * 2/2007 Saquib et al. ..... 347/185
7,298,387 B2 * 11/2007 Busch et al. ..... 347/194
2004/0196352 A1 10/2004 Busch et al. ..... 347/189
2005/0068404 A1 3/2005 Saquib et al. ..... 347/194

* cited by examiner

*Primary Examiner*—K. Feggins

(57) ABSTRACT

Techniques are disclosed herein for estimating parameters of a model of a thermal print head for use in performing thermal history control. In particular, techniques are disclosed for use in conjunction with a thermal print head having a plurality of print head elements and an associated heat sink. A sensitivity of a thermal print media to a temperature of the heat sink is identified. A sensitivity of the thermal print medium to a temperature of the plurality of print head elements is then identified based on the identified sensitivity of the thermal print medium to the temperature of the heat sink. Techniques are also disclosed for deriving conditions on estimated parameters of the print head model that determine the stability of the resulting thermal history control algorithm. Techniques are also disclosed for iteratively optimizing the values of those parameters.

36 Claims, 16 Drawing Sheets

PRINTER THERMAL RESPONSE CALIBRATION SYSTEM

CROSS REFERENCE TO RELATED APPLICATIONS

This application claims priority from U.S. Provisional Pat. App. Ser. No. 60/644,066, filed on Jan. 14, 2005, entitled "Printer Thermal Response Calibration System," which is hereby incorporated by reference.

This application is related to the following commonly owned patents and patent applications, all of which are incorporated by reference herein:

U.S. patent application Ser. No. 10/831,925, filed on Apr. 26, 2004, entitled "Thermal Response Correction System," and U.S. patent application Ser. No. 10/988,896, filed on Nov. 15, 2004, entitled "Thermal Response Correction System," both of which are continuations-in-part of U.S. patent application Ser. No. 09/934,703, filed on Aug. 22, 2001, entitled "Thermal Response Correction System," which issued as U.S. Pat. No. 6,819,347 on Nov. 16, 2004;

U.S. patent application Ser. No. 10/151,432, filed on May 20, 2002, entitled "Thermal Imaging System."

BACKGROUND

1. Field of the Invention

The present invention relates to thermal printing and, more particularly, to techniques for improving thermal printer output by compensating for the effects of thermal history on thermal print heads.

2. Related Art

Thermal printers typically contain a linear array of heating elements (also referred to herein as "print head elements") that print on an output medium by, for example, transferring pigment from a donor sheet to the output medium or by initiating a color-forming reaction in the output medium. The output medium is typically a porous receiver receptive to the transferred pigment, or a paper coated with the color-forming chemistry. Each of the print head elements, when activated, forms color on the medium passing underneath the print head element, creating a spot having a particular density. Regions with larger or denser spots are perceived as darker than regions with smaller or less dense spots. Digital images are rendered as two-dimensional arrays of very small and closely-spaced spots.

A thermal print head element is activated by providing it with energy. Providing energy to the print head element increases the temperature of the print head element, causing either the transfer of pigment to the output medium or the formation of color in the receiver. The density of the output produced by the print head element in this manner is a function of the amount of energy provided to the print head element. The amount of energy provided to the print head element may be varied by, for example, varying the amount of power to the print head element within a particular time interval or by providing power to the print head element for a longer time interval.

In conventional thermal printers, the time during which a digital image is printed is divided into fixed time intervals referred to herein as "line times." Typically, a single row of pixels (or portions thereof) in the digital image is printed during a single line time. Each print head element is typically responsible for printing pixels (or sub-pixels) in a particular column of the digital image. During each line time, an amount of energy is delivered to each print head element that is calculated to raise the temperature of the print head element to a level that will cause the print head element to produce output having the desired density. Varying amounts of energy may be provided to different print head elements based on the varying desired densities to be produced by the print head elements.

One problem with conventional thermal printers results from the fact that their print head elements retain heat after the conclusion of each line time. This retention of heat can be problematic because, in some thermal printers, the amount of energy that is delivered to a particular print head element during a particular line time is typically calculated based on an assumption that the print head element's temperature at the beginning of the line time is a known fixed temperature. Since, in reality, the temperature of the print head element at the beginning of a line time depends on (among other things) the amount of energy delivered to the print head element during previous line times, the actual temperature achieved by the print head element during a line time may differ from the calibrated temperature, thereby resulting in a higher or lower output density than is desired. Further complications are similarly caused by the fact that the current temperature of a particular print head element is influenced not only by its own previous temperatures—referred to herein as its "thermal history"—but by the ambient (room) temperature and the thermal histories of other print head elements in the print head.

As may be inferred from the discussion above, in some conventional thermal printers, the average temperature of each particular thermal print head element tends to gradually rise during the printing of a digital image due to retention of heat by the print head element and the over-provision of energy to the print head element in light of such heat retention. This gradual temperature increase results in a corresponding gradual increase in density of the output produced by the print head element, which is perceived as increased darkness in the printed image. This phenomenon is referred to herein as "density shift."

Furthermore, conventional thermal printers typically have difficulty accurately reproducing sharp density gradients between adjacent pixels in both the fast scan and slow scan direction. For example, if a print head element is to print a white pixel following a black pixel, the ideally sharp edge between the two pixels will typically be blurred when printed. This problem results from the amount of time that is required to raise the temperature of the print head element to print the black pixel after printing the white pixel. More generally, this characteristic of conventional thermal printers results in less than ideal sharpness when printing images having regions of high density gradient.

The above referenced patents and patent applications disclose techniques for performing "thermal history control," i.e., compensating for the effects of thermal history on thermal print heads. The object of thermal history control is to control the temperature of print head elements in a thermal printer to more accurately render digital images in the face of thermal history effects.

More specifically, the techniques disclosed in the above-referenced patents and patent applications make use of a "thermal history control model" (or simply "THC model") which includes both a thermal model and a media model. Both of these models have parameters whose values need to be estimated to calibrate the system for optimal performance under particular conditions. Such parameter estimation can be difficult to perform. What is needed, therefore, are improved techniques for estimating the values of parameters in a thermal history control model.

SUMMARY

Techniques are disclosed herein for estimating parameters of a model of a thermal print head for use in performing thermal history control. In particular, techniques are disclosed for use in conjunction with a thermal print head having a plurality of print head elements and an associated heat sink. A sensitivity of a thermal print media to a temperature of the heat sink is identified. A sensitivity of the thermal print medium to a temperature of the plurality of print head elements is then identified based on the identified sensitivity of the thermal print medium to the temperature of the heat sink. Techniques are also disclosed for deriving conditions on estimated parameters of the print head model that determine the stability of the resulting thermal history control algorithm. Techniques are also disclosed for iteratively optimizing the values of those parameters.

For example, one embodiment of the present invention is directed to a computer-implemented method for use in conjunction with a thermal print head having a plurality of print head elements and an associated heat sink. The method includes: (A) identifying a sensitivity of a thermal print medium to a temperature of the heat sink; and (B) identifying a sensitivity of the thermal print medium to a temperature of the plurality of print head elements based on the identified sensitivity of the thermal print medium to the temperature of the heat sink.

Another embodiment of the present invention is directed to a computer-implemented method for use in conjunction with a thermal print head having a plurality of print head elements and an associated heat sink. The method includes: (A) identifying a plurality of output units having a plurality of printed densities produced by the thermal print head on a thermal print medium; (B) identifying a plurality of input energies associated with the plurality of printed densities; (C) identifying a media model relating a first temperature of the plurality of print head elements and the plurality of input energies to the plurality of printed densities on the thermal print medium; and (D) identifying a second temperature of the plurality of print head elements based on the plurality of printed densities, the plurality of input energies, and the media model.

Yet another embodiment of the present invention is directed to a computer-implemented method for use in conjunction with a thermal print head having an associated heat sink. The method includes (A) identifying a media model relating temperature of a print head element in the thermal print head and input energy to printed density on a thermal print medium; (B) selecting initial parameters of the media model; (C) identifying a thermal model relating thermal print head input energy to thermal print head element temperature; (D) selecting initial parameters of the thermal model; (E) providing a plurality of input energies to the thermal print head based on the initial parameters of the media model and the initial parameters of the thermal model to produce a plurality of printed densities on the thermal print medium at a plurality of heat sink temperatures; and (F) refining the parameters of the media model and the parameters of the thermal model based on the plurality of input energies, the plurality of printed densities, and the plurality of heat sink temperatures, and the initial parameters of the media and thermal models.

A further embodiment of the present invention is directed to a computer-implemented method for use in conjunction with a thermal print head having a plurality of print head elements and an associated heat sink. The method includes: (A) identifying a thermal model relating thermal print head input energy to thermal print head element temperature, the thermal model being characterized by a plurality of layers indexed by l, wherein L is the number of the plurality of layers, and wherein the thermal model is characterized by the equation $T^{(l)}(n)=T^{(l)}(n-1)\alpha_l+A_lE^{(l)}(n-1), l=0, \ldots, L-1$, wherein $E^{(l)}$ denotes an input energy applied to layer l, wherein $T^{(l)}$ denotes a temperature of layer l relative to layer l+1; and (B) selecting values of $\alpha_l$ and $A_l$ for $0 \leqq l < L$ in accordance with the following constraint: $\alpha_l+S(d)A_l \geqq x_l$, wherein $x_l$ is non-negative for $0 \leqq l < L$, wherein d is density, and wherein S(•) is a sensitivity function specifying a sensitivity of the thermal print medium to a temperature of the plurality of print head elements.

Other features and advantages of various aspects and embodiments of the present invention will become apparent from the following description and from the claims.

DETAILED DESCRIPTION

Figure 1A:
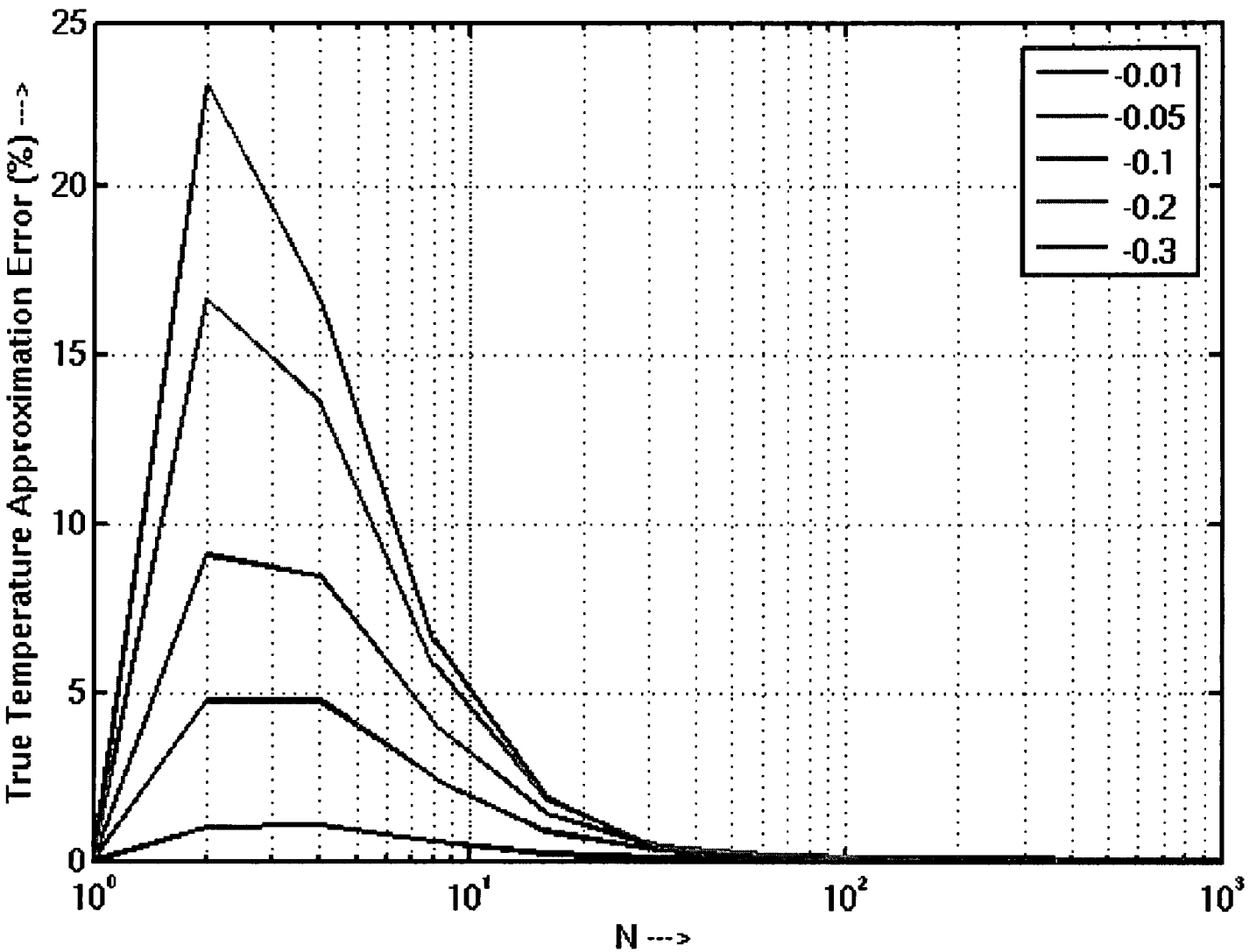
FIGS. 1A-1B are graphs illustrating the degree of fit between approximated and actual temperatures of a print head in a thermal printer according to one embodiment of the present invention.

The above referenced patents and patent applications disclose techniques for performing "thermal history control," i.e., compensating for the effects of thermal history on thermal print heads. The object of thermal history control is to control the temperature of print head elements in a thermal printer to more accurately render digital images in the face of thermal history effects.

More specifically, the techniques disclosed in the above-referenced patents and patent applications make use of a "thermal history control model" (or simply "THC model") which includes: (1) a thermal model, which models the relationship between energy input to the thermal print head elements and the resulting temperatures of those elements; and (2) a media model, which models the relationship between:

(a) the temperatures of the thermal print head elements and the input energies provided to them; and (b) the resulting density of output produced on the media.

Both the thermal model and the media model have parameters whose values need to be estimated to calibrate the system for optimal performance under particular conditions (e.g., for use with a particular print medium). Estimation of these parameters (referred to herein as "the THC parameters") typically involves using the thermal print head to print known data on a medium and then using a scanner or other device to measure the densities produced. Such measurements may produce inaccurate data for a variety of reasons, thereby reducing the accuracy of parameter estimation. The process is particularly subject to producing inaccurate data at the short time and spatial scales.

Such inaccuracies may be caused, for example, by scanner flare, mis-registration due to non-uniform printer and scanner transport mechanism, and cropping algorithms that extract the printed image using alignment marks laid down by the printer but do not model how these marks may be distorted by the thermal effects. On the other hand, the data at long time and spatial scales typically is very accurate. Until now, however, there has been no means to take advantage of this fact since it has been difficult to independently control the behavior of the THC algorithm on these vastly different scales. The reason for this difficulty in separating the behavior of the THC algorithm at short and long time scales may be traced back to the sensitivity parameter of the media model, which incorporates both the statics (long time effects) and the dynamics (short time effects) of the THC algorithm. This integration of effects at both time scales into a single model parameter is undesirable because the inaccurate short term data can corrupt the THC long term behavior. Lack of independent control makes adjusting the THC parameters to correct for short term inaccuracies very difficult without altering the static response of the THC algorithm.

Techniques are disclosed herein for extricating the component of the sensitivity parameter that controls the statics of the THC algorithm. The static component of sensitivity is referred to herein as the "effective sensitivity." More specifically, techniques are disclosed for accurately measuring the effective sensitivity from the data by making use of variables that are directly observable. This formulation takes advantage of the fact that the static data are very reliable. Having pinned down the effective sensitivity and gamma, the only remaining unknowns are the thermal model parameters.

Techniques are then disclosed for deriving conditions on the estimated parameters that determine the stability of the resulting THC algorithm. The THC algorithm exhibits a very interesting property at locations where the gamma and effective sensitivity are measured. In particular, these locations turn out to be fixed points of the algorithm in the sense that even if the thermal parameters are estimated incorrectly, there is no error in the printed density as long as the effective sensitivity and gamma are accurate.

This formulation has several advantages, such as the following. The number of parameters to estimate in the optimization phase is reduced, thereby significantly reducing the convergence times. The reduction in the number of parameters, coupled with a multi-resolution strategy for estimating the thermal model parameters, improves the likelihood of homing in on the global minimum without getting trapped in local minima. The independent control of the statics and dynamics allows the inaccurate estimates of the short term thermal parameters to be adjusted without changing the accuracy of the THC algorithm in the long term. Finally, the fixed point of the THC algorithm allows the estimate of effective sensitivity and gamma to be refined without any knowledge of the true thermal parameters.

Having described various aspects of the present invention in general terms, particular embodiments of the present invention will now be described in more detail. First, an embodiment of the printer model disclosed in the above-referenced patents and patent applications will be summarized briefly. Although certain embodiments will be described below in conjunction with particular media and thermal models, the same techniques are applicable to other media and thermal models as well. Additional details may be found in the referenced documents.

The printer model comprises a thermal model and a media model. The thermal model keeps track of the time history of the print head temperature as energy is applied to the heating elements. The model operates at multiple resolutions to maximize its computational efficiency. Let L denote the number of different resolutions layers and let l denote the layer index with l=0 and l=L−1 denoting the finest and coarsest resolution respectively. Let $T^{(l)}$ denote the relative temperature of layer l with respect to layer l+1. Let n denote the time index for each layer. At the finest resolution, n also corresponds to the line index of the printed image. Each layer updates its relative temperature as $$T^{(l)}(n)=T^{(l)}(n-1)\alpha_l+A_lE^{(l)}(n-1),l=0,\ldots,L-1, \quad \text{Equation 1}$$

where $E^{(l)}$ denotes the energy applied to layer l. The energy at the finest resolution $E^{(0)}$ is the same as the energy applied to the print head. The energy at the coarser resolution is obtained by the decimating the energy at the finer resolutions using the following recursion $$E^{(l)}=I_{l-1}^{l}E^{(l-1)},l-1,\ldots,L-1, \quad \text{Equation 2}$$

where $I_{l-1}^{l}$ is a decimation operator going from layer l−1 to layer l. The absolute temperatures $T_a^{(l)}$ are obtained recursively starting from the coarsest layer and propagating down to the finest resolution as $$T_a^{(l)}=I_{l+1}^{l}T_a^{(l+1)}+T^{(l)},l=L-1,\ldots,0, \quad \text{Equation 3}$$

where $I_{l-1}^{l}$ is a interpolation operator going from layer l+1 to layer l. Note that $T_a^{(L)}$ denotes the temperature reading obtained from a thermistor attached to the heat sink.

The media model relates the printed density d to the applied energy and the absolute temperature of the print head elements $T_a$:

$$E=\Gamma^{-1}(d)+S(d)(T_a-T_{\Gamma a}(d)), \quad \text{Equation 4}$$

where $T_{\Gamma a}(d)$ is the absolute temperature of the print head elements for density d under the conditions the gamma curve Γ(•) is measured. If the thermal model specified in Equations 1-3 is employed, then the temperature of the heating elements $T_a$ is given by the absolute temperature $T_a^{(0)}$ of the finest layer. The print density is obtained as the solution to the non-linear Equation 4.

The gamma curve of a printer relates the input energy to the printed density. However, in a thermal printer, the gamma curve is not unique since the print density depends not only on the input energy, but also on the absolute temperature of the heating elements and media. This leads to many different ways in which the gamma curve can be measured. Note that the media model given in Equation 4 also requires the absolute print head element temperature $T_{\Gamma a}(d)$ at which the gamma curve is measured. We refer to this temperature as the operating temperature.

In general, it is difficult to obtain a closed form expression for the operating temperature. However, the conditions under which the gamma is measured may be restricted to facilitate the computation of the operating temperature. For instance, the printer may be supplied with a constant energy E for N lines, and the print density d then measured at the $N^{th}$ line. The gamma curve may then be obtained by constructing a function $\Gamma_N(\bullet)$ that relates the input energy E to the output density d such that $d=\Gamma_N(E)$. Note that the dependence of the gamma curve on N is explicit in the notation. For this restricted specification, the operating temperature for any density d is easy to obtain for any linear thermal model using $$T_{\Gamma a}(d)=T_{\Gamma s}+T_{scale}{}^{N}\Gamma_N^{-1}(d), \qquad \text{Equation 5}$$

where $T_{\Gamma s}$ is the heat sink temperature at which the gamma is measured and $T_{scale}{}^{N}$ is the cumulative temperature relative to the heat sink at the $N^{th}$ line for a constant unity energy applied to the print head. For the particular thermal model specified in Equations 1-3, $T_{scale}{}^{N}$ is given as $$T_{scale}^{N}=\sum_{l=0}^{L-1}\frac{A_l\left(1-\alpha_l^{N/dec^l}\right)}{1-\alpha_l}. \qquad \text{Equation 6}$$

dec is the decimation factor between the layers. The above equation is only valid when N is an integral multiple of $dec^{L-1}$. A more general equation for any N and layer-dependent decimation factors is also easy to obtain but is omitted here for the sake of simplicity. For the subsequent treatment, we will assume N is an integer multiple of $dec^{L-1}$.

The sensitivity S used in the media model (Equation 4) is defined as the change in energy required for a change in temperature of the heating elements to keep the print density constant, i.e.

$$S(d_0)=\left.\frac{dE}{dT_a}\right|_{d=d_0}. \qquad \text{Equation 7}$$

The above definition implies that S(•) cannot be measured directly from observable data, since it requires the temperature of the heating elements, which is not observable. In one embodiment of the present invention, this problem is solved by defining an equivalent quantity referred to as "effective sensitivity," which denotes the change in energy required for a change in the heat sink temperature to keep the print density constant $$S_{eff}^{N}(d_0)=\left.\frac{dE}{dT_s}\right|_{d=d_0}. \qquad \text{Equation 8}$$

Figure 3A:
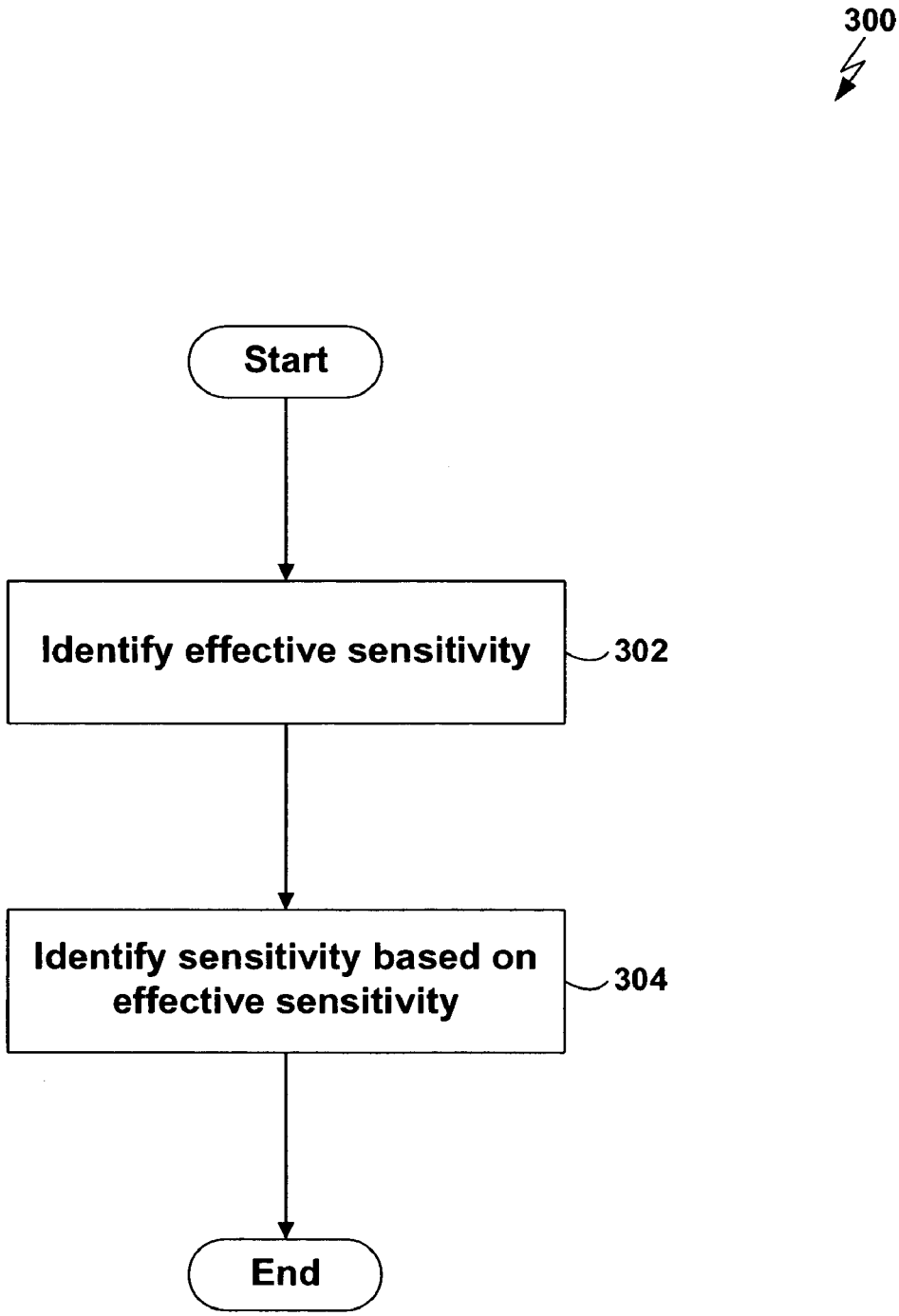
FIG. 3A is a flowchart of a method for identifying a sensitivity of a thermal print medium to a temperature of a heat sink in a thermal printer.

Note that the effective sensitivity is not unique anymore; it depends on the $N^{th}$ pixel at which the sensitivity is measured. Techniques will be disclosed herein for identifying the sensitivity S(•) based on the effective sensitivity $S_{eff}{}^{N}(\bullet)$. In other words, as illustrated by the flowchart shown in FIG. 3A, a method 300 is disclosed which identifies the effective sensitivity $S_{eff}{}^{N}(\bullet)$, which is a sensitivity of a thermal print medium to the temperature of the heat sink (step 302). The method 300 then identifies the sensitivity S(•), which is a sensitivity of the thermal print medium to the temperature of the heating elements, based on the identified effective sensitivity $S_{eff}{}^{N}(\bullet)$ (step 304).

Techniques will now be disclosed for measuring the effective sensitivity directly from observable data. The relation between the (non-unique) effective sensitivity and the (unique) sensitivity S will also be explained. Consider applying a constant energy E for N lines to a print head with heat sink temperature $T_s$. The absolute temperature of the heating elements at the $N^{th}$ line is given as $$T_a(N)=T_s+T_{scale}{}^{N}E. \qquad \text{Equation 9}$$

To obtain the print density d at the $N^{th}$ line, the expressions for the operating temperature (Equation 5) and the absolute temperature of the heating elements (Equation 9) may be substituted into the media model (Equation 4)

$$E=\Gamma_N^{-1}(d)+S(d)(T_s+T_{scale}^{N}E-T_{\Gamma s}-T_{scale}^{N}\Gamma_N^{-1}(d)) \qquad \text{Equation 10}$$

$$\Gamma_N^{-1}(d)=E-\frac{S(d)}{1-S(d)T_{scale}^{N}}(T_s-T_{\Gamma s}).$$

Taking the derivative of the above equation with respect to the heat sink temperature $T_s$ while keeping the density d constant produces $$S_{eff}^{N}(d)=\left.\frac{dE}{dT_s}\right|_d=\frac{S(d)}{1-S(d)T_{scale}^{N}}. \qquad \text{Equation 11}$$

Since the sensitivity S is always less than zero and $T_{scale}{}^{N}\geqq 0$, it follows that $$S_{eff}{}^{N}(d)\leqq S(d). \qquad \text{Equation 12}$$

The upper bound is met when $T_{scale}{}^{N}=0$. Therefore, at N=0 the effective sensitivity is the same as the sensitivity $$S_{eff}{}^{0}(d)=S(d). \qquad \text{Equation 13}$$

This would be one way of computing the sensitivity S directly from the data without any knowledge of the thermal model. However, in practice, the density measured at line 0 is often very unreliable due to scanner flare and misregistration errors. Even if these errors could be eliminated, measuring the sensitivity in this fashion is still undesirable due to model mismatch errors. Note that the media model represented by Equation 4 is only an approximation to the true media model. Although the sensitivities far away from typical operating temperatures usually depend on the absolute temperature, the media model (Equation 4) assumes them to be independent of the absolute temperature. Consequently, the sensitivity obtained at line 0 may be different from that obtained at larger values of N.

It may also be seen from Equation 11 that as $T_{scale}{}^{N}\rightarrow\infty$, $S_{eff}{}^{N}(d)\rightarrow 0$. $T_{scale}{}^{N}$ becomes larger as the temperature sensing device moves further away from the heating elements. For instance, if the heat sink is made thicker, $S_{eff}{}^{N}$ will become smaller. Conversely, if the temperature sensing devices are brought closer to the heating elements, $S_{eff}{}^{N}$ will become larger and in the limit become equal to the sensitivity. This is intuitively clear, since in the limit the temperature sensing device will be measuring the heating element temperature directly and therefore the measured effective sensitivity is the original sensitivity.

Figure 3B:
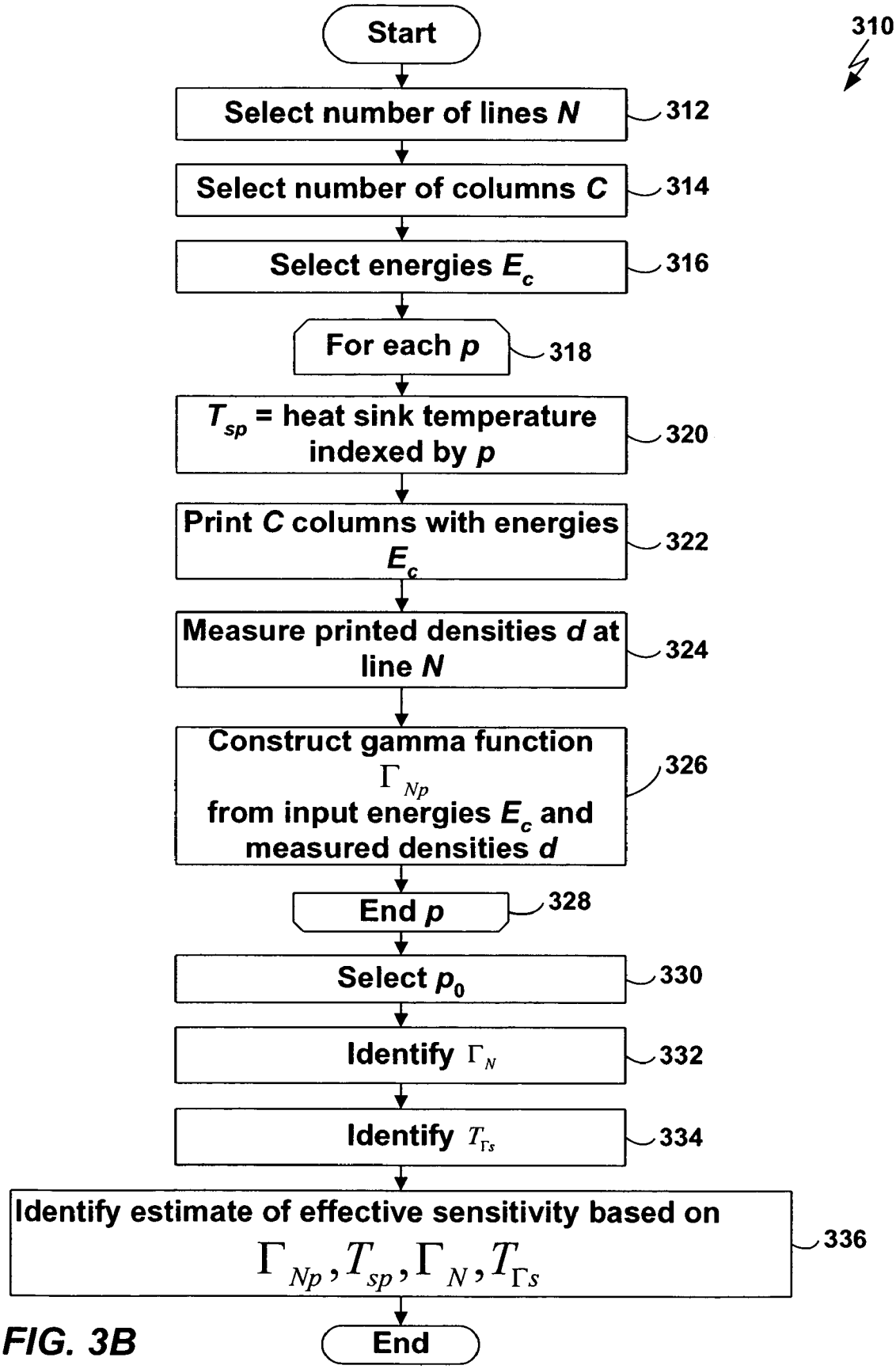
FIG. 3B is a flowchart of a method for estimating the sensitivity identified in FIG. 3A.

Density measurements made at multiple heat sink temperatures may be used to estimate the effective sensitivity. Referring to FIG. 3B, a flowchart is shown of a method 310 for estimating the effective sensitivity in this manner. Note that the method 310 may be a step in the process of identifying the effective sensitivity (step 302 in FIG. 3A).

Figure 4:
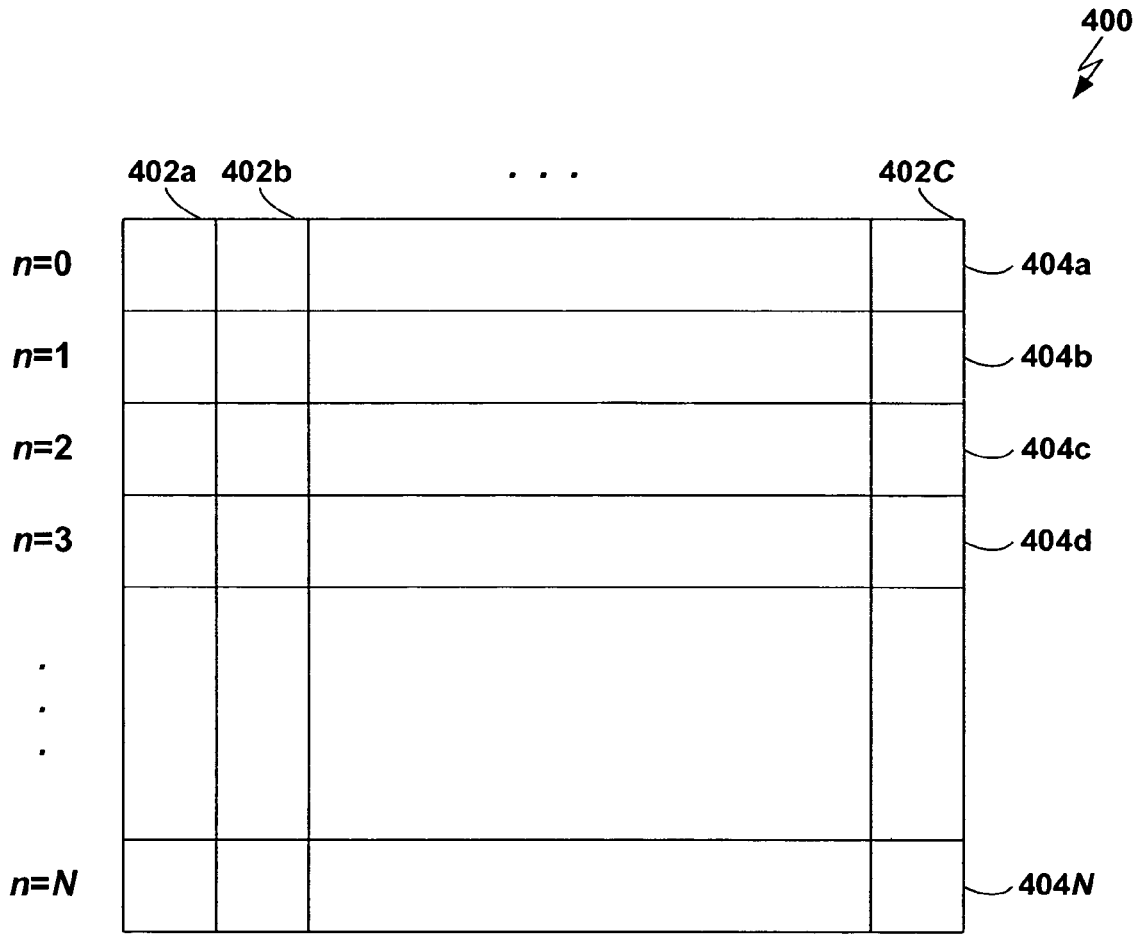
FIG. 4 is an illustration of a printed target image according to one embodiment of the present invention.

As will be described in more detail, the method 310 involves printing a target image. Referring to FIG. 4, a simplified example 400 of such a target is illustrated. The target includes a plurality of C columns 402*a*-C, each having N lines 404*a*-N, where n is an index into the lines 404*a*-N. Values are selected for N (step 312) and C (step 314). Note that any values may be selected for N and C.

In the present example, each of the columns 402*a*-C is printed with a constant input energy $E_c$, where $0 \leqq c < C$. A plurality of input energies $E_c$ are selected (step 316) for use in printing the columns 402*a*-C.

Let p index the heat sink temperatures and let P be the number of heat sink temperatures, where $0 \leqq p < P$. For each p (step 318) having a corresponding heat sink temperature $T_{sp}$ (step 320), columns 402*a*-C are printed using corresponding input energies $E_c$, for $0 \leqq c < C$ (step 322). The densities of columns 402*a*-C are measured at line N (step 324) to construct a gamma curve $\Gamma_{Np}$ for heat sink temperature $T_{sp}$ (step 326).

Steps 320-326 are repeated (step 328) for the remaining heat sink temperatures $T_{sp}$, thereby producing gamma curves $\Gamma_{Np}$ for all p. A value $p_0$ may be chosen (step 330), and a corresponding gamma function $\Gamma_N = \Gamma_{p_0}$ may be identified (step 332). The heat sink temperature $T_{\Gamma s} = T_{sp_0}$ for $\Gamma_N$ may also be identified (step 334). The effective sensitivity may be obtained from Equation 10 in step 334 by averaging the estimates over the different heat sink temperatures as $$\hat{S}_{eff}^{N}(d) = \frac{1}{P}\sum_{p \neq p_0} \frac{\Gamma_{Np}^{-1}(d) - \Gamma_N^{-1}(d)}{T_{sp} - T_{\Gamma s}}. \qquad \text{Equation 14}$$

Figure 5:
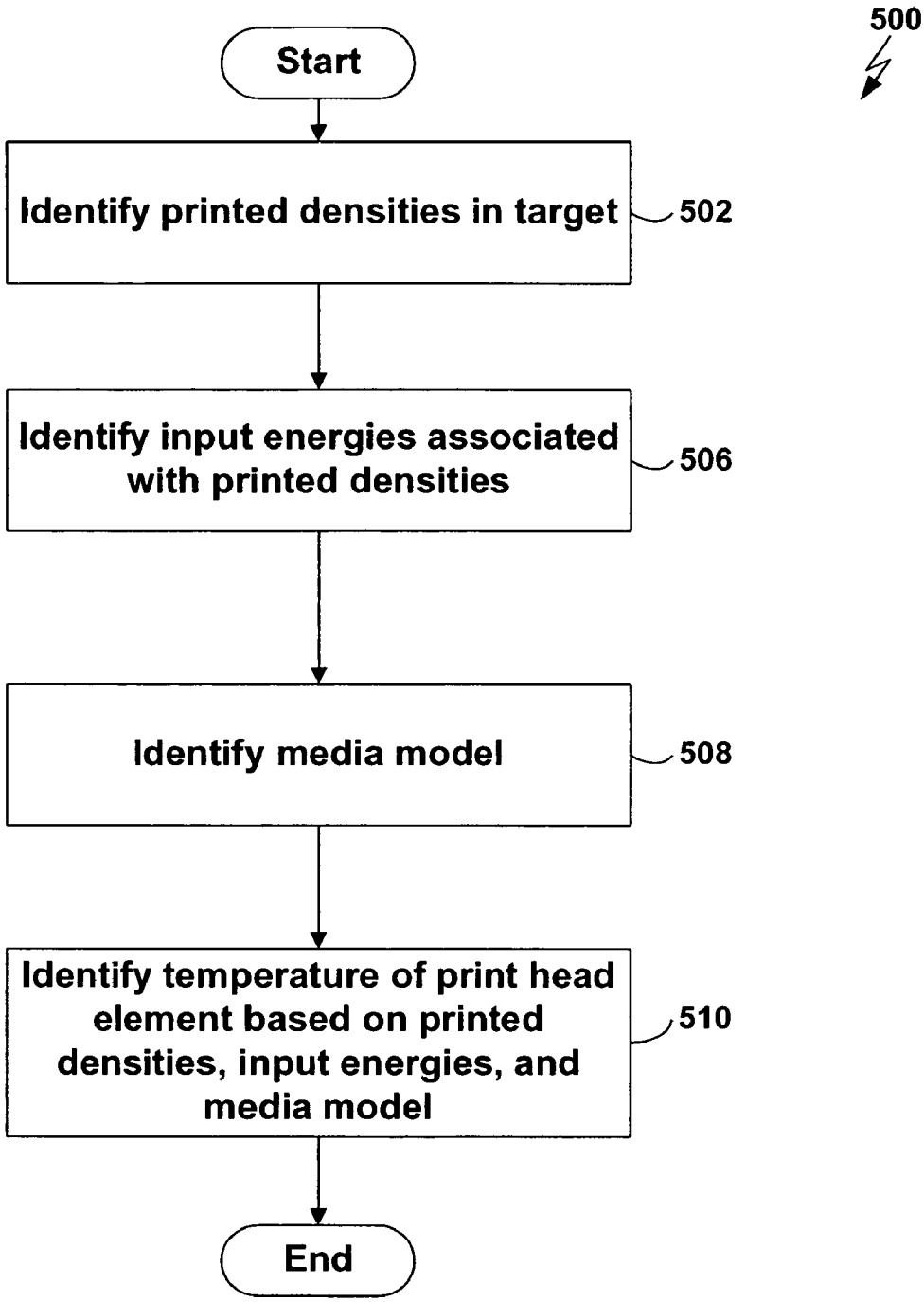
FIG. 5 is a flowchart of a method for inferring an absolute temperature of thermal print head elements according to one embodiment of the present invention.

Techniques will now be disclosed for using measurements of the media model parameters (such as $\Gamma_N(\bullet)$ and $S_{eff}^{N}(\bullet)$) to infer the absolute temperature of the heating elements as a function of time without any knowledge of the thermal model parameters. Referring to FIG. 5, a flowchart is shown of a method 500 that may be used to infer this absolute temperature.

The method 500 identifies the printed densities d(n) printed in the target at times (lines) n (step 502) and the energies E(n) supplied to the print head at times (lines) n (step 506). The method 500 also identifies the media model represented by Equation 4 (step 508).

$\hat{T}_a(n)$ denotes the unknown absolute temperature of the heating elements at time or line n. The method 500 may identify the temperature $\hat{T}_a(n)$ based on the printed densities $\hat{d}(n)$, the energies E(n) (step 510) as follows:

$$E(n) = \Gamma_N^{-1}(\hat{d}(n)) + S(\hat{d}(n))(\hat{T}_a(n) - T_{\Gamma s} - T_{scale}^{N}\Gamma_N^{-1}(\hat{d}(n))) \qquad \text{Equation 15}$$

$$\hat{T}_a(n) = T_{\Gamma s} + T_{scale}^{N}E(n) + \frac{E(n) - \Gamma_N^{-1}(\hat{d}(n))}{S_{eff}^{N}(\hat{d}(n))}.$$

This is an important result because it shows that the underlying unknown temperature may be inferred without any explicit knowledge of the thermal parameters except for $T_{scale}^{N}$, which is an aggregate measure of the thermal parameters.

The knowledge that at n=0, $T_a(0) = T_s$ (the heat sink temperature at which the target is printed) may be used to obtain a preliminary estimate of $T_{scale}^{N}$. The method 500 illustrated in FIG. 5 may be repeated M times for a set of M energies and M heat sink temperatures. M density measurements may also be taken at line 0. Let m denote the sample index. Let $\hat{d}_m(0)$, $E_m(0)$ and $T_s(m)$ denote the line 0 density, energy and heat sink temperature measurement of the $m^{th}$ sample respectively. Then the estimate of $T_{scale}^{N}$ is given as $$\hat{T}_{scale}^{N} = \frac{1}{M}\sum_{m=0}^{M-1}\left[\frac{T_s(m) - T_{\Gamma s}}{E_m(0)} + \frac{\Gamma_N^{-1}(\hat{d}_m(0)) / E_m(0) - 1}{S_{eff}^{N}(\hat{d}_m(0))}\right] \qquad \text{Equation 16}$$

Figure 8A:
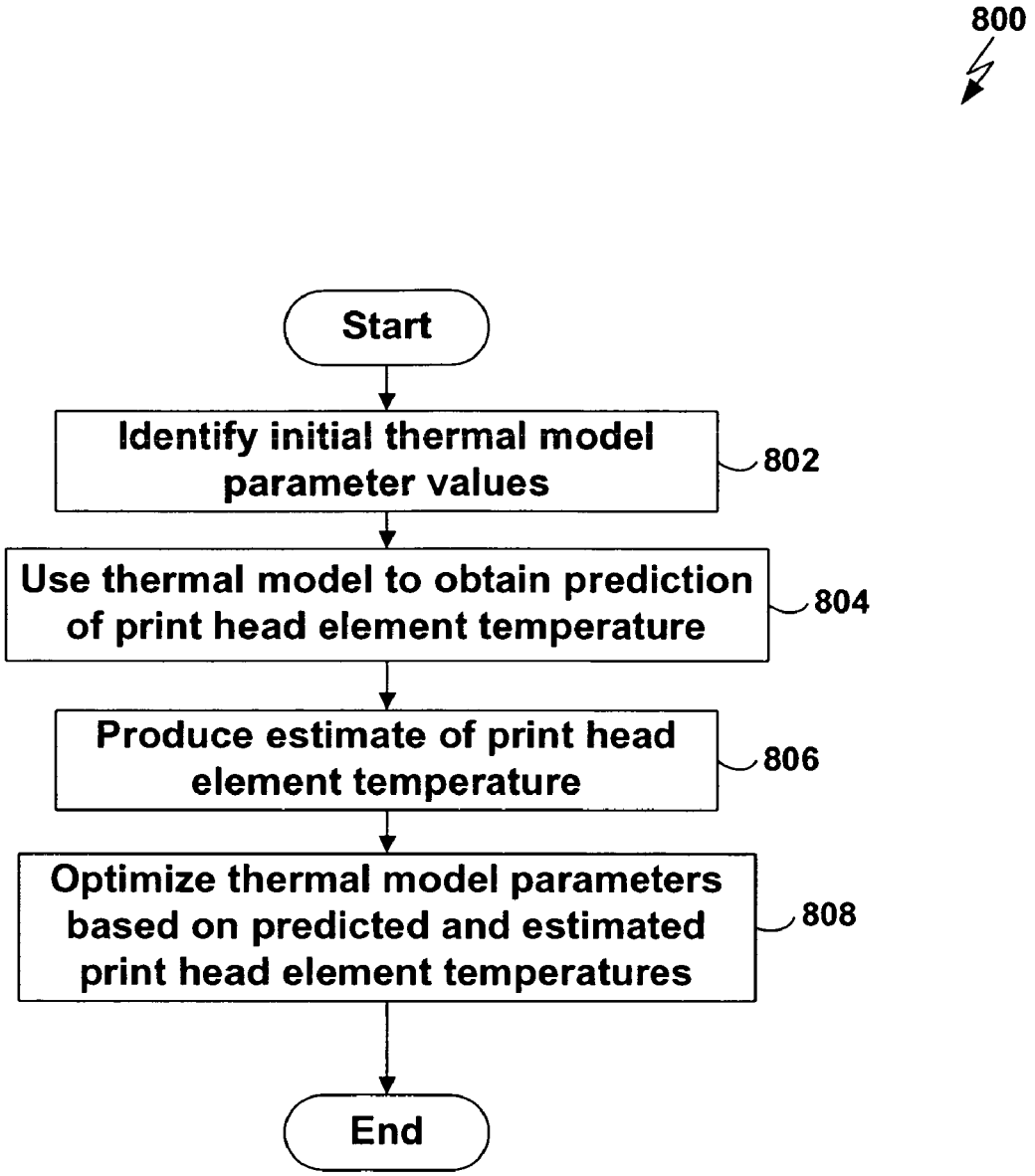
FIGS. 8A-8B are flowcharts of methods for optimizing parameter values of a thermal model according to one embodiment of the present invention.

Referring to FIG. 8A, a flowchart is shown of a method 800 that may be used to optimize the parameters of the thermal model based on the estimated absolute temperature $\hat{T}_a(n)$. The method 800 identifies initial values for the parameters of the thermal model (step 802). The method 800 uses the thermal model (as shown in Equations 1-3) to obtain a prediction $T_a(n)$ of the absolute temperature of the print head elements (step 804). The method 800 uses Equation 15 to produce an estimate $\hat{T}_a(n)$ of the absolute temperature of the print head elements (step 806). The method 800 iteratively tunes the thermal model parameters by minimizing the error between the predicted temperature $T_a(n)$ and the estimated temperature $\hat{T}_a(n)$ of the print head elements (step 808).

Techniques will now be disclosed to enforce the stability of the THC algorithm. In the z-transform domain, a one layer THC algorithm has a single pole at $$z = \alpha_0 + S(d_0)A_0. \qquad \text{Equation 17}$$

Therefore, the energy computed by the THC algorithm will oscillate when $\alpha_0 + A_0 S(d_0) < 0$ and become unstable when $|\alpha_0 + A_0 S(d_0)| > 1$. Note that the instability condition is equivalent to $\alpha_0 + A_0 S(d_0) < -1$ because of the constraints $\alpha_0 < 1$, $A_0 > 0$ and $S(d_0) < 0$. The condition for a stable single-layer system with no oscillation is given as $$\alpha_0 + S(d_0)A_0 \geqq 0 \qquad \text{Equation 18}$$

The two layer THC has two poles in the z-transform domain given by the roots of the following equation $$(1 - z^{-1}\alpha_0)(1 - z^{-1}\alpha_1) - z^{-1}S(d_0)(A_0(1 - z^{-1}\alpha_1) + A_1(1 - z^{-1}\alpha_0)) = 0. \qquad \text{Equation 19}$$

The poles are given as, $$z = \frac{\alpha'_0 + \alpha'_1}{2} \pm \sqrt{\left(\frac{\alpha'_0 - \alpha'_1}{2}\right)^2 + S^2(d_0)A_0A_1}, \qquad \text{Equation 20}$$

where $$\alpha'_i = \alpha_i + A_i S(d_0). \qquad \text{Equation 21}$$

In practice, $S(d_0)A_i \ll 1$ and the roots can be approximated as $$z = \{\alpha'_0 - \Delta, \alpha'_1 + \Delta\}, \qquad \text{Equation 22}$$

where $$\Delta = \frac{S^2(d_0)A_0A_1}{\alpha'_1 - \alpha'_0}. \qquad \text{Equation 23}$$

Without loss of generality, it may be assumed that $\alpha'_0 \leqq \alpha'_1$, which makes $\Delta \geqq 0$ and $\alpha'_0 - \Delta \leqq \alpha'_1 + \Delta$. The condition for a stable non-oscillating two-layer system is then given as $$\alpha_0 + S(d_0)A_0 \geq \frac{S^2(d_0)A_0A_1}{\alpha_1' - \alpha_0'}. \quad \text{Equation 24}$$

A comparison of Equation 18 and Equation 24 shows that a non-oscillating single layer system can become oscillating by the presence of the second layer. Therefore, the condition for oscillation becomes more stringent for a multiple layer system. How much effect the upper layers have on the poles of the lower layers depends upon how much they contribute to the overall temperature rise. In practice, the upper layers' contribution to the total temperature becomes progressively smaller. This is consistent with their heat capacities being larger, which translates to smaller A values for these upper layers. When the first two layers dominate in a multi-layer system, the condition for non-oscillation remains essentially the same as in Equation 24 but becomes slightly more stringent by the addition of a small term $\epsilon>0$ as follows $$\alpha_l+S(d_0)A_l>\Delta+\epsilon, \forall l. \quad \text{Equation 25}$$

Figure 6:
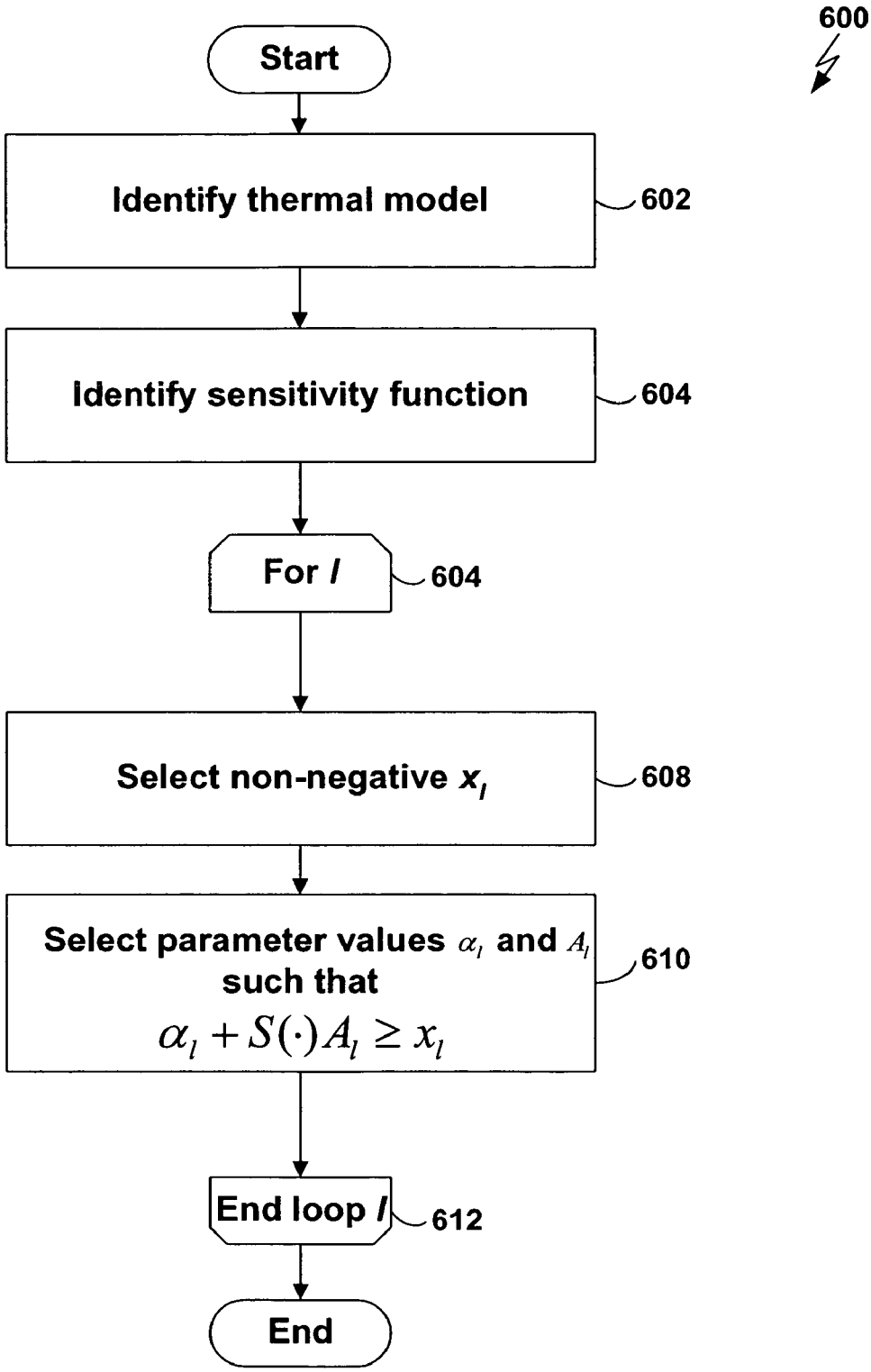
FIG. 6 is a flowchart of a method for selecting thermal model parameter values according to one embodiment of the present invention.

A general method 600 is illustrated in FIG. 6 for selecting values for $\alpha_l$ and $A_l$ for $0 \leqq l<L$ to produce a stable system. A thermal model of the form shown in Equations 1-3 is identified (step 602). A sensitivity function S(•) is identified (step 604). Then, for each value of l (i.e., for $0 \leqq l<L$) (step 606), a non-negative value of $x_l$ is selected (step 608). Values of $\alpha_l$ and $A_l$ are chosen which satisfy the constraint represented by Equation 26 (step 610).

$$\alpha_l+S(d)A_l \geqq x_l \quad \text{Equation 26}$$

Steps 608 and 610 are repeated for the remaining values of l to select values of $x_l$ for $0 \leqq l<L$ (step 612).

Figure 8B:
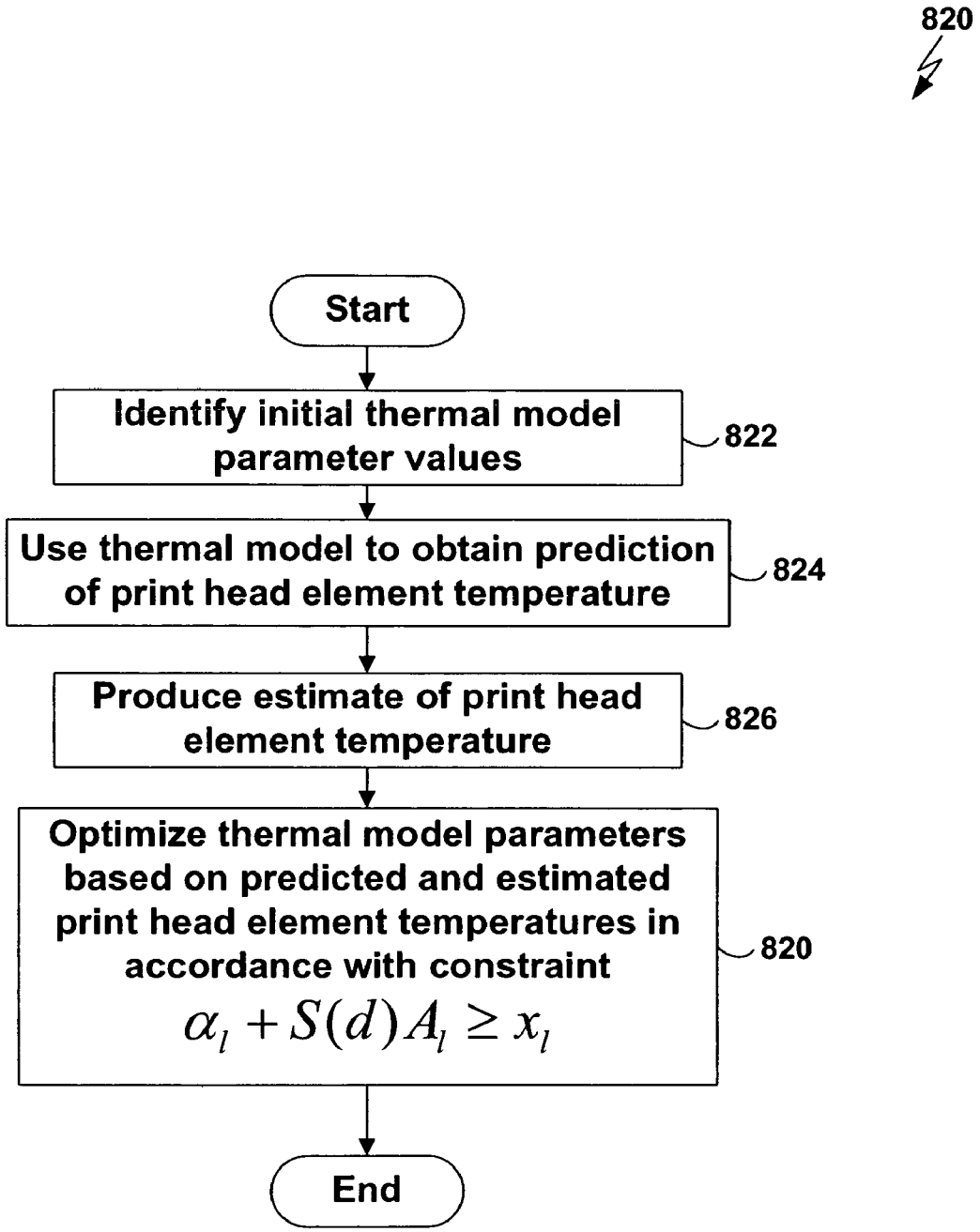

Referring to FIG. 8B, a flowchart is shown of a method 820 that may be used to optimize the parameters of the thermal model based on the estimated absolute temperature $\hat{T}_a(n)$, and in accordance with the constraints reflected in Equation 26. The method 820 identifies initial values for the parameters of the thermal model (step 822). The method 820 uses the thermal model (as shown in Equations 1-3) to obtain a prediction $T_a(n)$ of the absolute temperature of the print head elements (step 824). The method 820 uses Equation 15 to produce an estimate $\hat{T}_a(n)$ of the absolute temperature of the print head elements (step 826). The method 820 iteratively tunes the thermal model parameters by minimizing the error between the predicted temperature $T_a(n)$ and the estimated temperature $\hat{T}_a(n)$ of the print head elements, while ensuring that the values of $\alpha_l$ and $A_l$ satisfy the constraints reflected in Equation 26 (step 828).

Assuming that estimates exist for parameters of the thermal and media models, examples of techniques will now be disclosed for refining those estimates. The example procedure described below involves printing a strip target that has constant density down the page with THC actively controlling the energy to the print head. The printed targets are then scanned and the density measurements are used to produce corrections to the existing parameters to improve their accuracy. Other targets, however, such as those not having constant density, may also be employed.

More specifically, let the symbol ˆ on any parameter denote an estimate of that parameter. The ˆ on computed variables signifies that the variables have been computed using estimated parameters. For example $\hat{A}$, $\hat{\alpha}$, $\hat{\Gamma}$, $\hat{S}$, and $\hat{S}_{eff}$ denote estimates of the thermal and media model parameters, while $\hat{T}$, $\hat{E}$, etc. denote computed quantities such as temperature and energy using the estimated parameters. The absence of ˆ denotes true parameters and variables computed using true parameters. In an iterative procedure, the true parameters may represent the refined or updated values of the parameters. The differences between true and estimated parameters or variables is denoted using a Δ preceding the parameter or variable and represents the desired correction we are interested in estimating.

Consider attempting to print a constant density down the page using the THC algorithm with the current estimate of the thermal and media model parameters (for example, $\hat{A}$, $\hat{\alpha}$, $\hat{\Gamma}$, $\hat{S}$, and $\hat{S}_{eff}$). The THC algorithm computes an estimate of the print head element temperatures and then actively controls the input energy using an estimate of the media model and the print head element temperature. This estimated energy is intended to print a constant density down the page. However, the parameter estimates employed by the THC algorithm may differ from the true thermal and media parameters of the printer, and the printed densities may not be exactly constant down the page. The goal is to derive what these true parameters are based on the measured print density and current values of the thermal and media model parameters. The first step involved is determining the actual or true temperature of the print head elements and the actual or true density produced by the printer when using the estimated energy from the THC calculation. The true temperature of the print head may be approximated as $$T_a(N) \approx T_{scale}{}^N(\hat{\Gamma}_N{}^{-1}(d_0)+\hat{S}_{eff}(d_0)(T_s-T_{\Gamma s}))+T_s \quad \text{Equation 27}$$

Figure 1B:
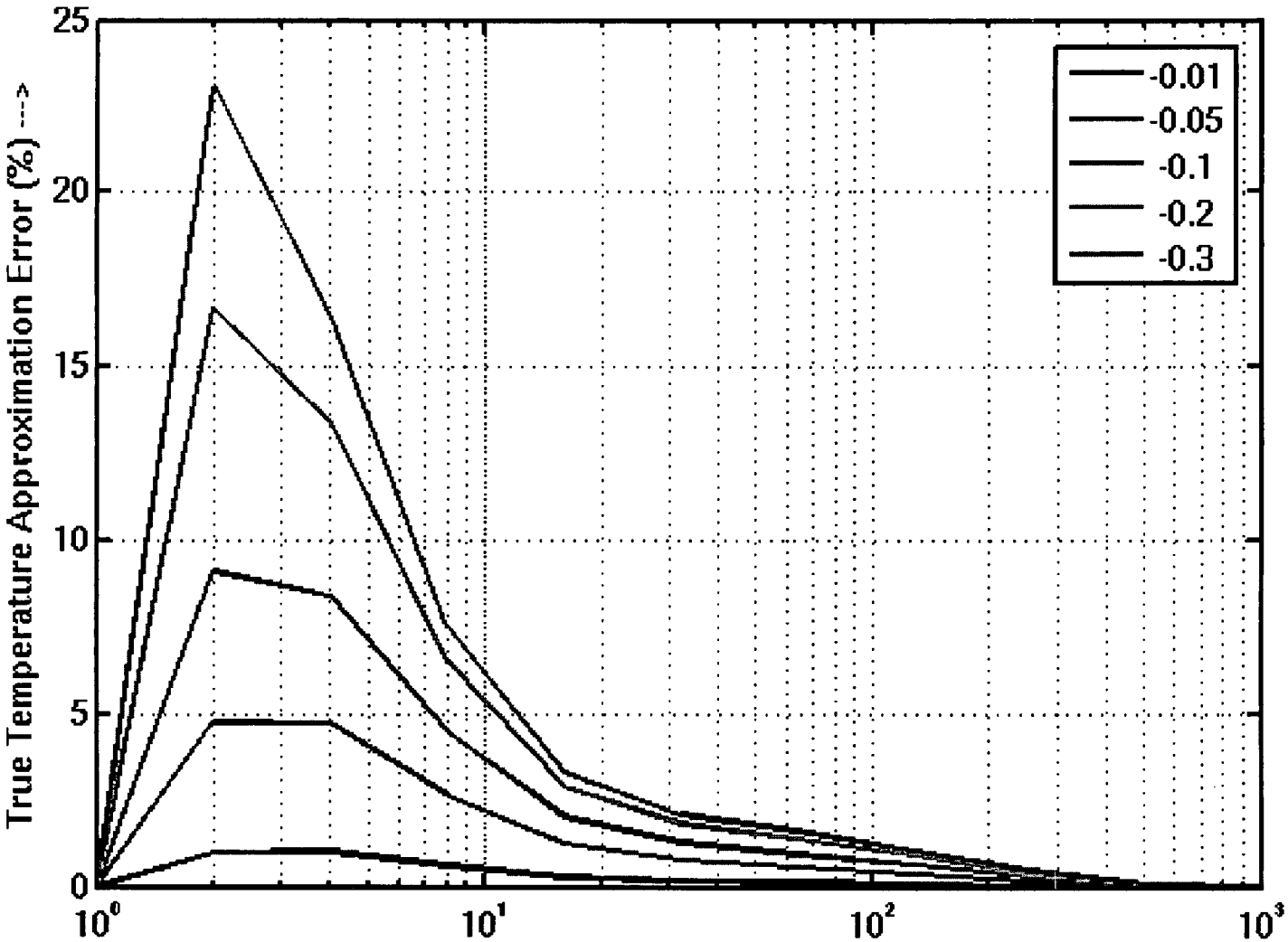

FIGS. 1A and 1B are plots of the approximation error for different values of $S(d_0)A_0$. FIG. 1A shows how good the approximation shown in Equation 27 is to the true print head temperature as a function of N and $S(d_0)A_0$, when driven by a 3 layer THC using the estimated parameters. The estimated time constants in lines for the thermal model are {1.8473, 12.9650,110.9617}. The plots in both FIG. 1A and FIG. 1B show the percentage approximation error when the true thermal time constants are {3.9484,2.4594,47.9277} and {3.9484,54.9877,216.0185} respectively.

The true temperature approximation improves for large N or small $S(d_0)A_0$. FIG. 1A shows the percentage error when the true thermal time constants are smaller than the estimated time constants and FIG. 1B shows a similar plot when the true time constants are longer. As seen from the plots, the longer the true time constant is, the larger N is required to be to achieve the same level of accuracy.

Let $d_0(N)$ denote the actual density printed at the $N^{th}$ line with THC active while trying to achieve a constant density of $d_0$. Substituting the approximate expression for the true temperature (Equation 27) into the media model with true parameters produces $$\hat{\Gamma}_N{}^{-1}(d_0)+\hat{S}_{eff}(d_0)(T_s-T_{\Gamma s})=\Gamma_N{}^{-1}(d_0(N))+S_{eff}(d_0(N))(T_s-T_{\Gamma s}). \quad \text{Equation 28}$$

If there is no mismatch between the estimated media model parameters (gamma and effective sensitivity) and the true media model parameters, Equation 28 indicates that $d_0(N)=d_0$. Therefore, even if the estimated thermal parameters are incorrect, the THC algorithm still delivers the desired density at the $N^{th}$ line. This is a very useful result since it allows the estimates of the media model to be refined independently of the thermal parameters.

A number of samples are printed with THC active at multiple heat sink temperatures and requested densities. Let p index the heat sink temperatures and m index the number of requested densities. Let $d_{mp}$ and $T_{sp}$ denote the requested densities and the heat sink temperatures respectively. Let the heat sink temperature corresponding to index p=0 equal the heat sink temperature $T_{\Gamma s}$ at which the gamma is measured.

The density samples at p=0 allow the gamma curve estimate to be refined independently of the error in effective sensitivity. Substituting $T_s=T_{s0}=T_{\Gamma s}$ in Equation 28 produces the true gamma from the measured density $d_{m0}(N)$ as $$d_{m0}(N)=\Gamma_N(\hat{\Gamma}_N^{-1}(d_{m0})). \quad \text{Equation 29}$$

Once the true gamma is estimated, the true effective sensitivity may be computed using samples at heat sink temperatures other than the one at which gamma is measured (p≠0) as follows $$S_{eff}(d_{mp}(N)) = \hat{S}_{eff}(d_{mp}) - \frac{\Gamma_N^{-1}(d_{mp}(N)) - \hat{\Gamma}_N^{-1}(d_{mp})}{T_{sp} - T_{\Gamma s}},\ p \neq 0. \quad \text{Equation 30}$$

Note that the correction to the effective sensitivity is obtained at sparse locations given by the values of $d_{mp}(N)$. The effective sensitivity at other points may be obtained by smoothly interpolating between these points.

Once the true gamma and effective sensitivity are determined using density measurements at the $N^{th}$ line, the remaining measurements at all other lines may be used to refine the thermal parameters. This may be accomplished using some standard optimization algorithm to find optimal values of the true thermal parameters to minimize the error between the observed print density values and the predicted density values.

The predicted density values may be obtained by first computing the true temperature of the print head using the thermal model with the true thermal parameters and the energy computed by THC using the estimated parameters. Second, the media model with true media parameters may be used to convert the true temperature and applied energy into a predicted density.

Note that the media model requires the sensitivity instead of effective sensitivity. The sensitivity may be computed from the effective sensitivity as $$S(d) = \frac{S_{eff}^N(d)}{1 + T_{scale}^N S_{eff}^N(d)}. \quad \text{Equation 31}$$

Figure 7:
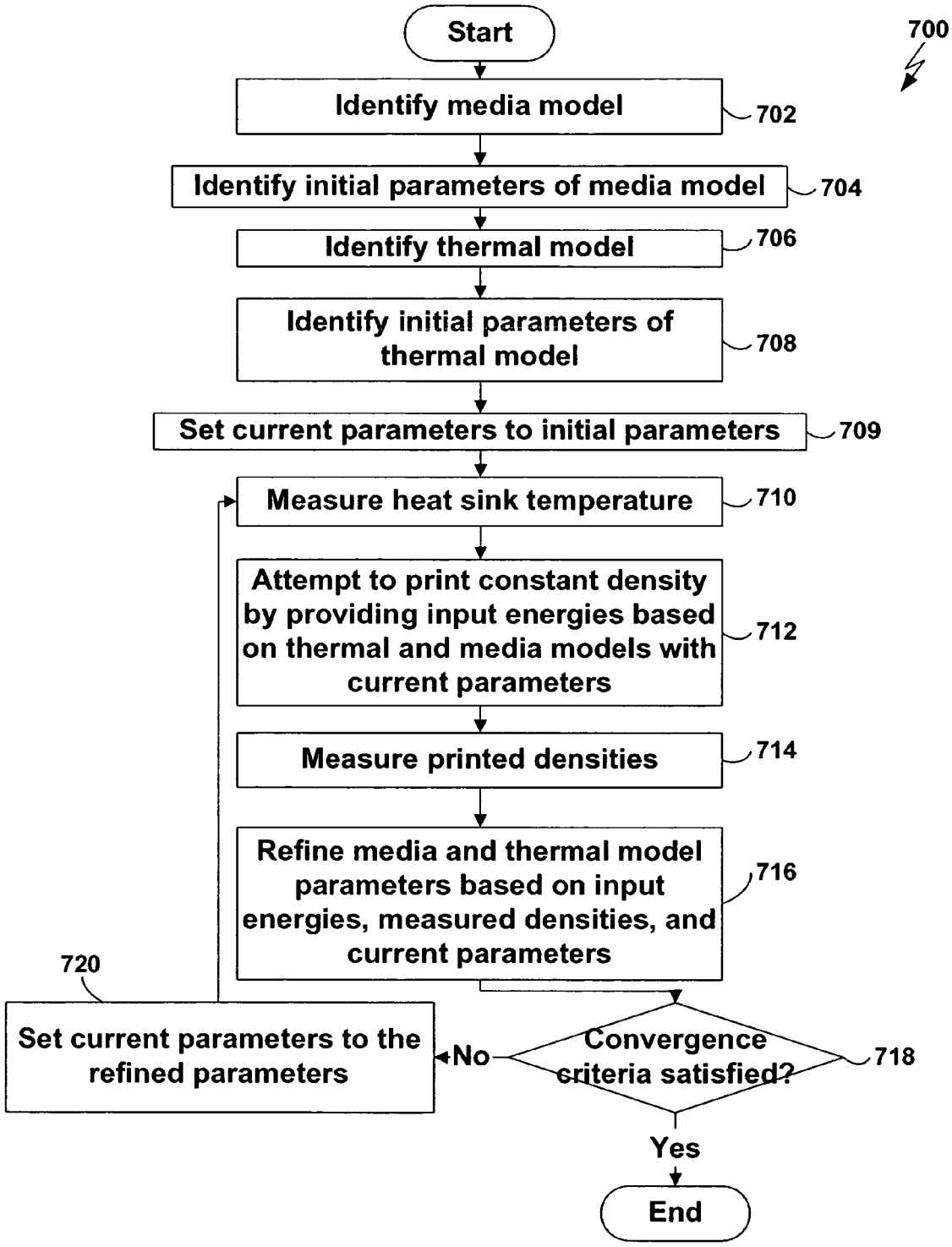
FIG. 7 is a flowchart of a method for refining estimates of thermal and media model parameter values according to one embodiment of the present invention.

FIG. 7 shows a flowchart of a method 700 for refining the estimates of the THC thermal and media model parameters. A media model (such as the media model represented by Equation 4) is identified (step 702) and initial parameter values are selected (step 704). Similarly, a thermal model (such as the thermal model represented by Equations 1-3) is identified (step 706) and initial parameter values are selected (step 708). The remainder of the method 700 makes use of "current" values of the thermal and media model parameters. The method 700 sets the current values of the parameters to the initial values of the parameters (e.g., $\hat{A}$, $\hat{\alpha}$, $\hat{\Gamma}$, $\hat{S}$, and $\hat{S}_{eff}$) (step 709). The current heat sink temperature is measured (step 710).

A constant density is then attempted to be printed, by actively using the THC algorithm to select input energies to provide to the thermal print head based on the current media and thermal model parameter values, and the heat sink temperature measured in step 710 (step 712). The actual printed densities are measured (step 714), and the current media and thermal model parameter values are refined based on the input energies, the measured densities, and the current values of the media and thermal model parameters (step 716). For example, Equations 29 and 30 may be used to obtain refined values for gamma ($\Gamma_N$) and effective sensitivity ($S_{eff}$) based on the current estimates of gamma ($\hat{\Gamma}_N$) and effective sensitivity ($\hat{S}_{eff}$). Updated values of the thermal model parameters (e.g., A and $\alpha$) may be obtained by minimizing the error between the measured density and predicted density, as described above.

Convergence criteria may be defined, and if the convergence criteria are not satisfied (step 718), steps 710-716 in FIG. 7 may be repeated with the most recently-refined values of the media and thermal model parameters being used as the current parameter values in the next iteration (step 720). The convergence criteria may, for example, require that the difference between the refined and current parameters be below a certain threshold, or that the error between the measured density and the predicted density be below a certain threshold.

FIG. 2 qualitatively shows the observed density profiles with a 3 layer THC active for a number of different cases where the estimated thermal parameters differ from the true parameters. In all of these cases, it is assumed that the estimate of effective sensitivity and gamma are correct. The requested density is 0.75 and N=250. As expected, the density profiles are very close to 0.75 at N=250 for all cases irrespective of the thermal model parameters. We observe that a negative ΔA and a positive Δα produces a valley in the observed density profile (FIG. 2A), whereas the reversal of signs on the errors produces a peak (FIGS. 2B and 2E). A negative ΔA and/or a negative Δα produces monotonically decreasing density (FIGS. 2C and 2F), whereas positive errors produces monotonically increasing density (FIG. 2D).

Figure 2A:
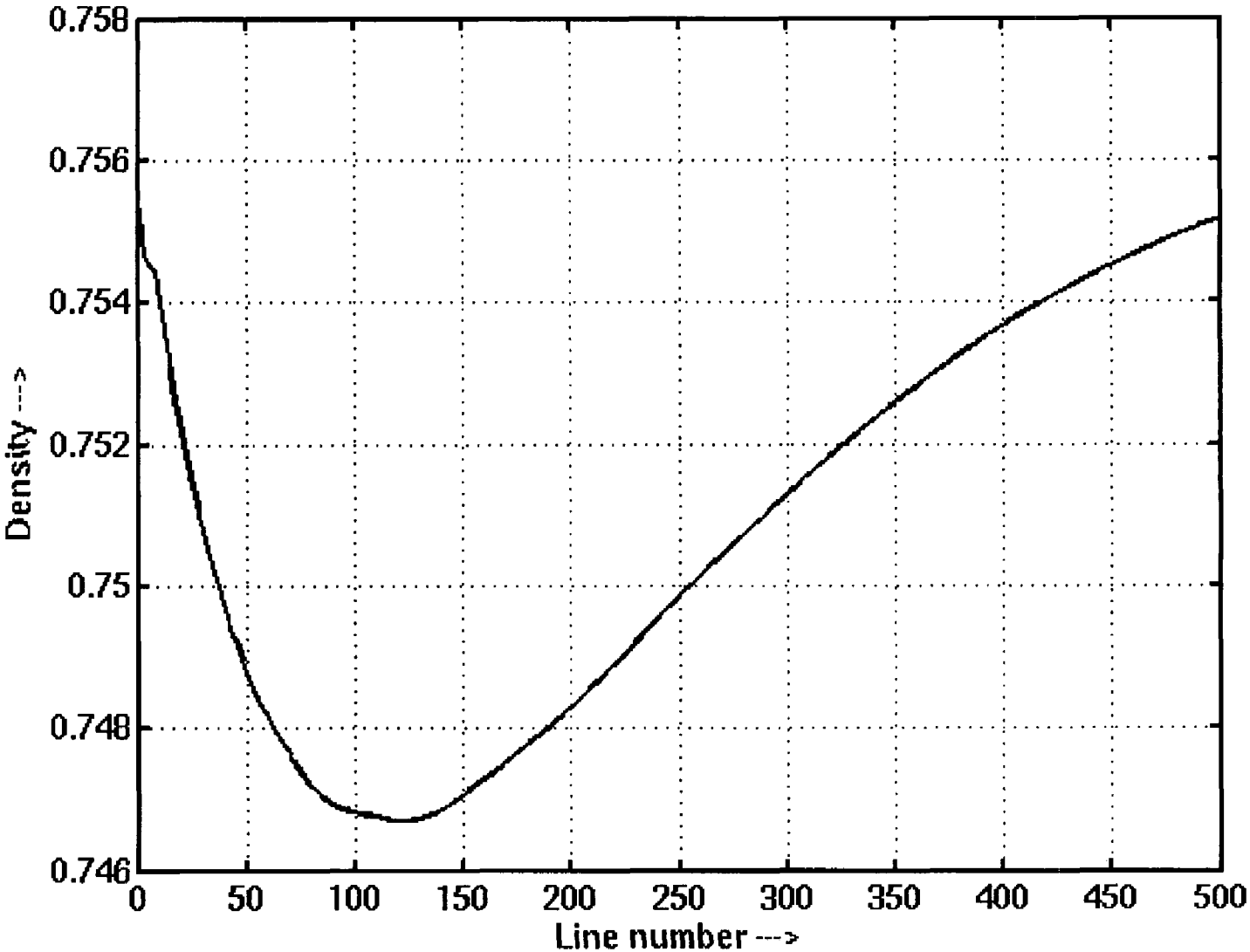
FIGS. 2A-2F are graphs qualitatively showing observed density profiles produced by a thermal print head according to one embodiment of the present invention.
Figure 2B:
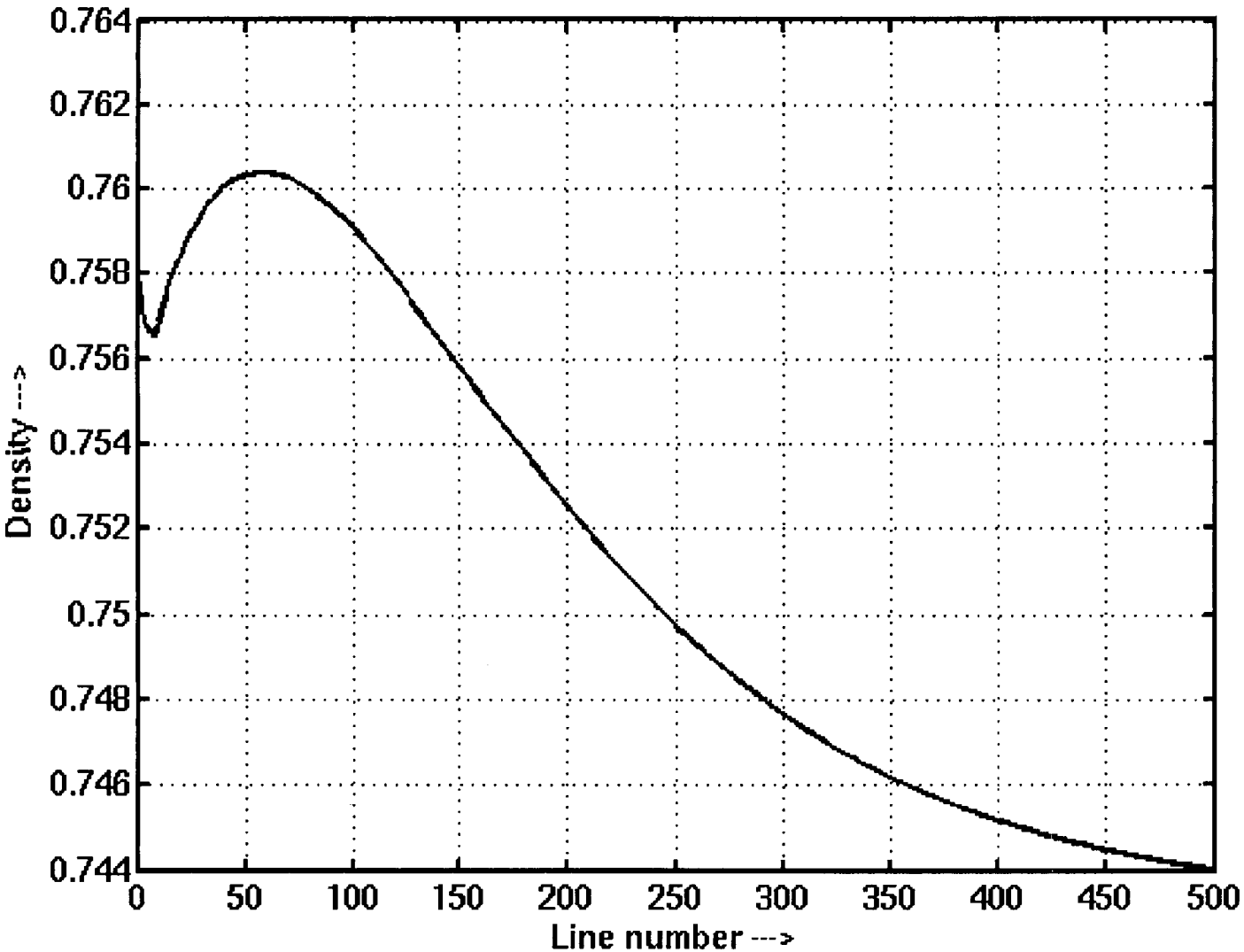
Figure 2C:
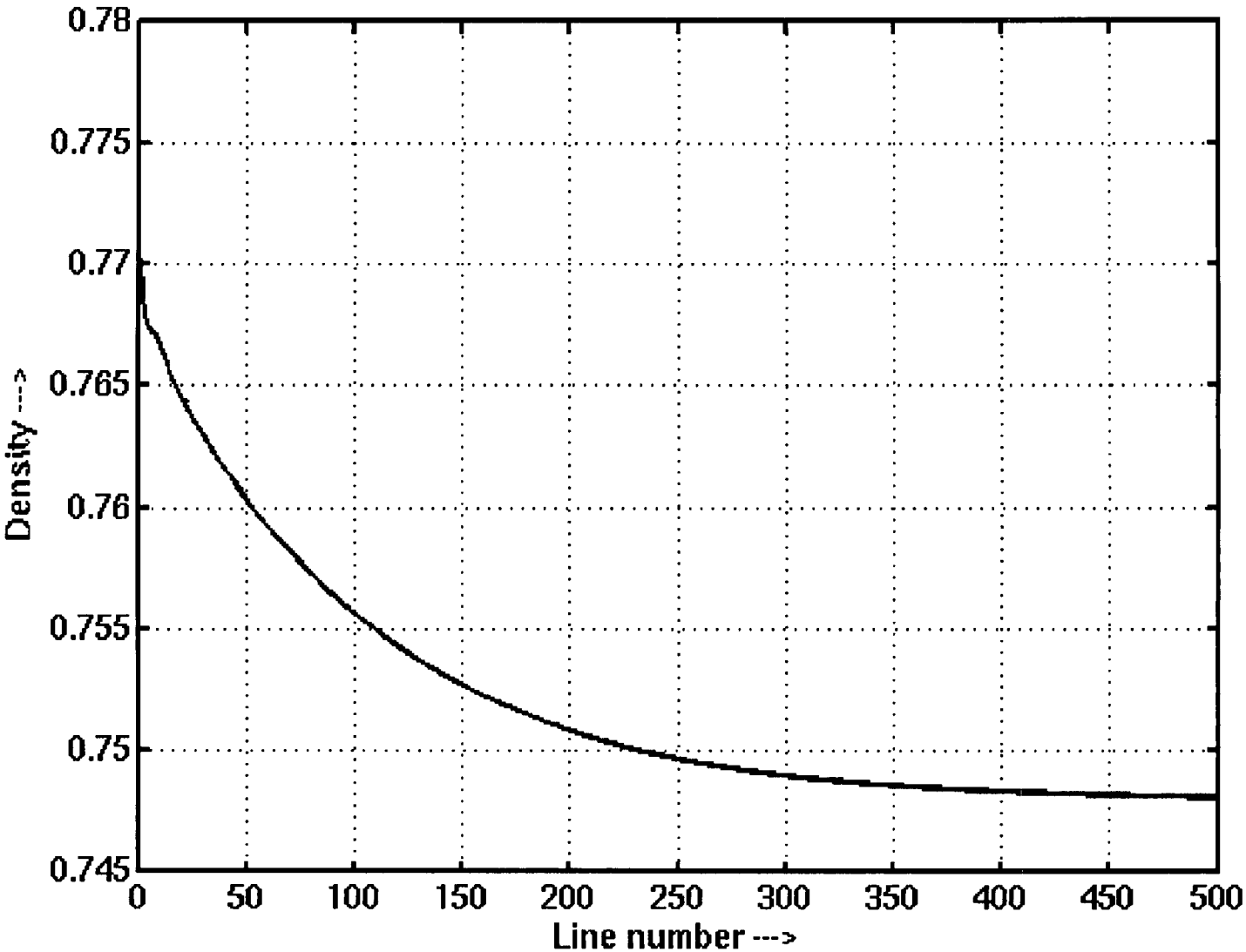
Figure 2D:
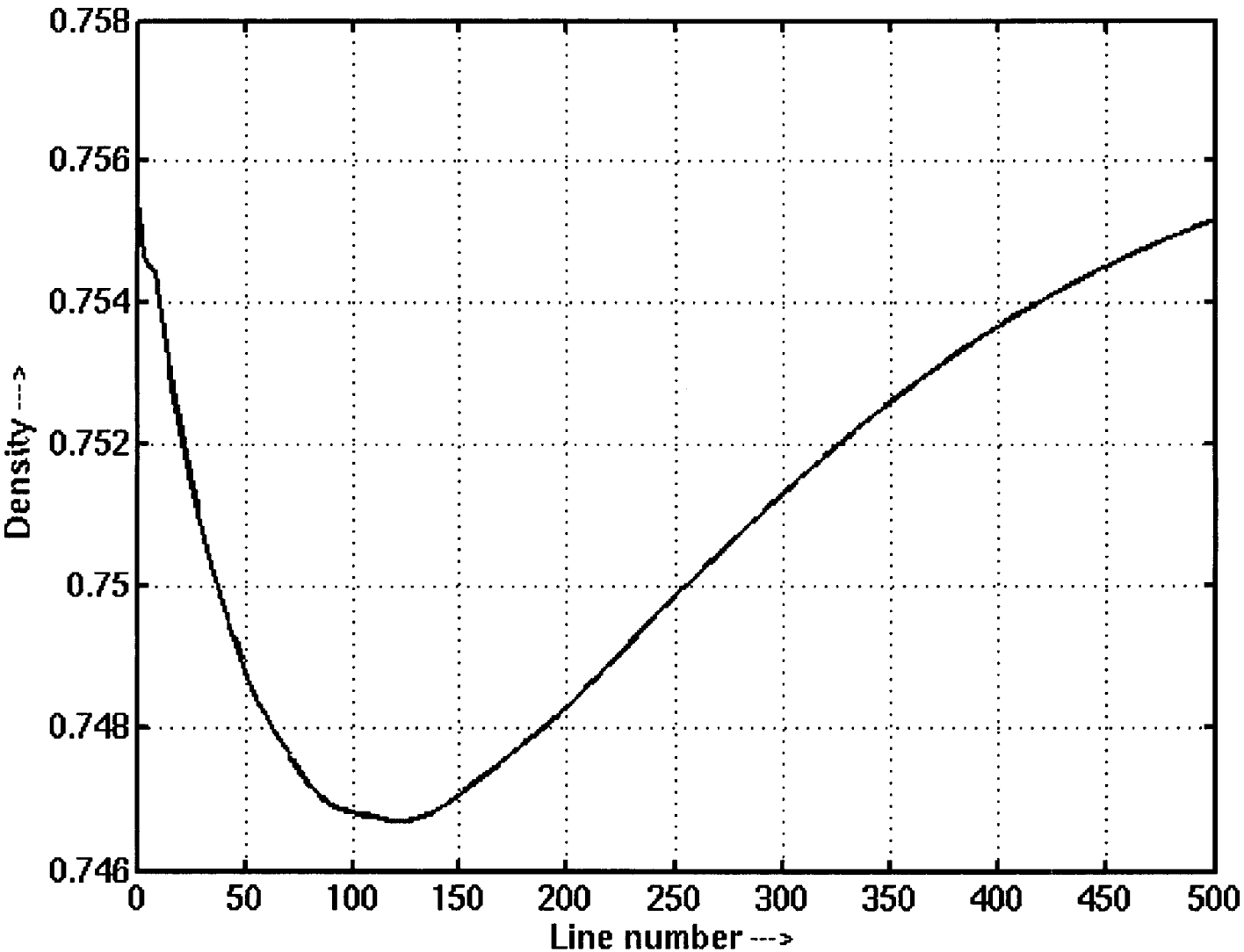
Figure 2E:
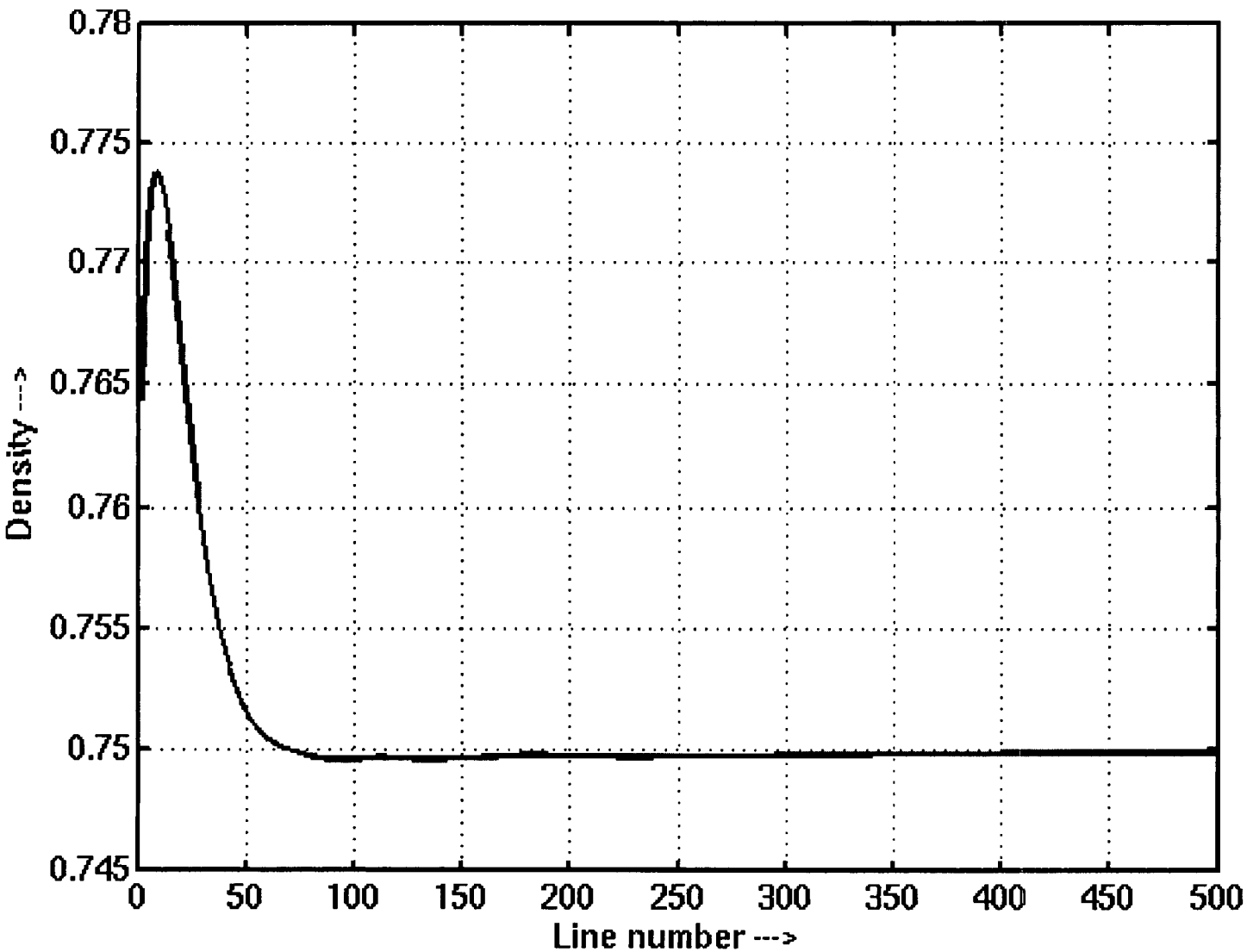
Figure 2F:
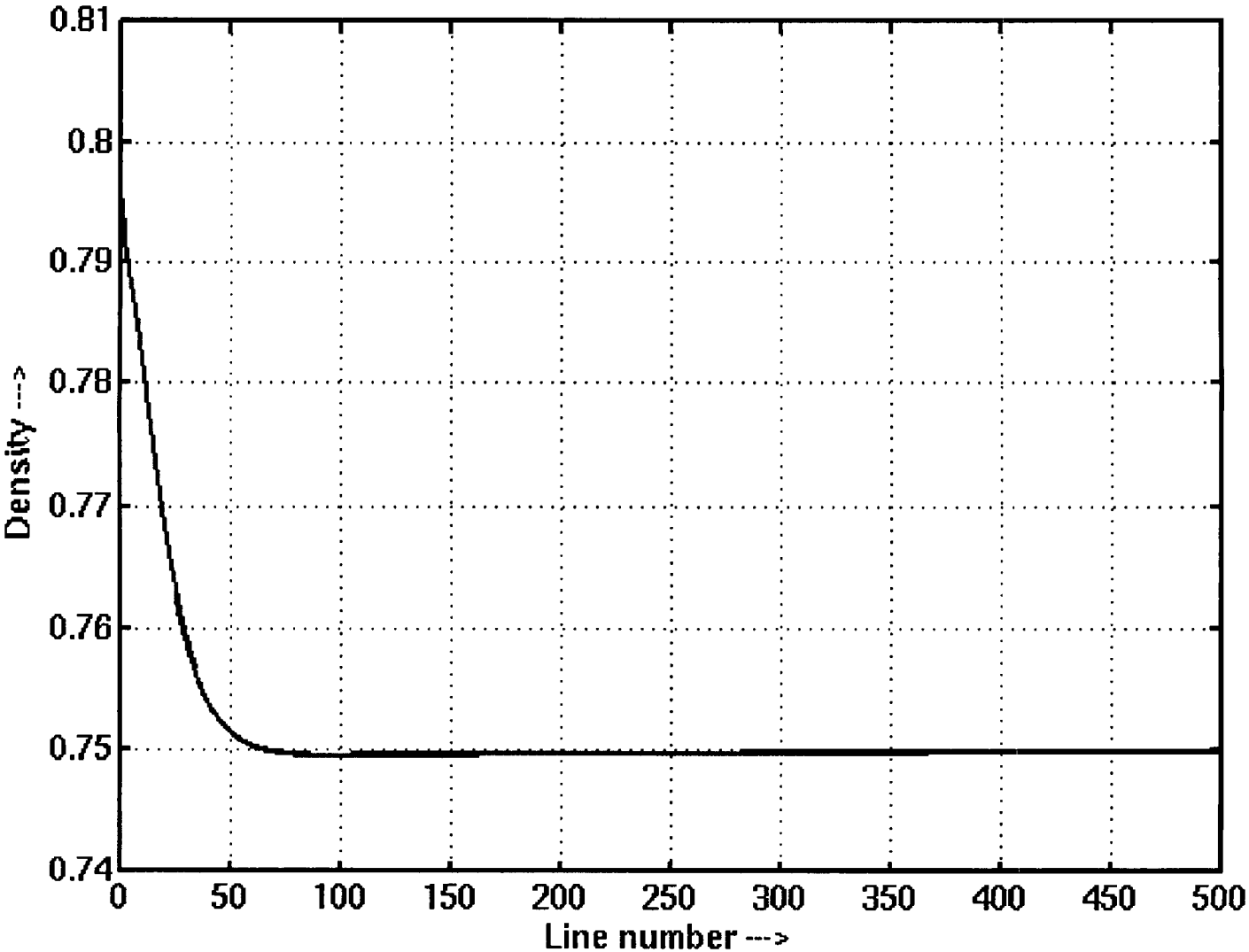

FIGS. 2E and 2F show density profiles for errors in layer 1, whereas FIGS. 2A-2D show density profiles for errors in layer 2. Since the different THC layers control different temporal and spatial scales, we can easily determine which THC layer has an error by observing the scale of the error in the printed density profile. This provides an easy way to independently tweak each of the THC layer parameters and leads to a multi-resolution strategy where the fine (layer 0) parameters are corrected first using only a small initial portion of the observed profile and the other layer parameters are corrected subsequently one by one in order of resolution using larger and larger portions of the observed density profile.

It is to be understood that although the invention has been described above in terms of particular embodiments, the foregoing embodiments are provided as illustrative only, and do not limit or define the scope of the invention. Various other embodiments, including but not limited to the following, are also within the scope of the claims. For example, elements and components described herein may be further divided into additional components or joined together to form fewer components for performing the same functions.

Although specific thermal and media models are disclosed herein, embodiments of the present invention are not limited to use in conjunction with those particular thermal and media models. Rather, techniques disclosed herein may be used in conjunction with a variety of thermal and media models. Furthermore, particular temperatures, such as the heating element temperatures $T_a$, may be obtained either through use of a thermal model or by measurement.

The techniques described above may be implemented, for example, in hardware, software, firmware, or any combination thereof. The techniques described above may be implemented in one or more computer programs executing on a programmable computer including a processor, a storage medium readable by the processor (including, for example, volatile and non-volatile memory and/or storage elements), at least one input device, and at least one output device. Program code may be applied to input entered using the input device to perform the functions described and to generate output. The output may be provided to one or more output devices.

Each computer program within the scope of the claims below may be implemented in any programming language, such as assembly language, machine language, a high-level procedural programming language, or an object-oriented programming language. The programming language may, for example, be a compiled or interpreted programming language.

Each such computer program may be implemented in a computer program product tangibly embodied in a machine-readable storage device for execution by a computer processor. Method steps of the invention may be performed by a computer processor executing a program tangibly embodied on a computer-readable medium to perform functions of the invention by operating on input and generating output. Suitable processors include, by way of example, both general and special purpose microprocessors. Generally, the processor receives instructions and data from a read-only memory and/or a random access memory. Storage devices suitable for tangibly embodying computer program instructions include, for example, all forms of non-volatile memory, such as semiconductor memory devices, including EPROM, EEPROM, and flash memory devices; magnetic disks such as internal hard disks and removable disks; magneto-optical disks; and CD-ROMs. Any of the foregoing may be supplemented by, or incorporated in, specially-designed ASICs (application-specific integrated circuits) or FPGAs (Field-Programmable Gate Arrays). A computer can generally also receive programs and data from a storage medium such as an internal disk (not shown) or a removable disk. These elements will also be found in a conventional desktop or workstation computer as well as other computers suitable for executing computer programs implementing the methods described herein, which may be used in conjunction with any digital print engine or marking engine, display monitor, or other raster output device capable of producing color or gray scale pixels on paper, film, display screen, or other output medium.

Printers suitable for use with various embodiments of the present invention typically include a print engine and a printer controller. The printer controller receives print data from a host computer and generates page information, such as a logical halftone to be printed based on the print data. The printer controller transmits the page information to the print engine to be printed. The print engine performs the physical printing of the image specified by the page information on the output medium.

What is claimed is:

1. A computer-implemented method for use in conjunction with a thermal print head having a plurality of print head elements and an associated heat sink, the method comprising:

(A) identifying a sensitivity of a thermal print medium to a temperature of the heat sink; and (B) identifying a sensitivity of the thermal print medium to a temperature of the plurality of print head elements based on the identified sensitivity of the thermal print medium to the temperature of the heat sink.

2. The method of claim 1, wherein (A) comprises:

(A)(1) identifying the sensitivity of the thermal print medium to the heat sink temperature based on a plurality of printed densities produced by the thermal print head, a plurality of heat sink temperatures associated with the plurality of printed densities, and a plurality of input energies associated with the plurality of printed densities.

3. The method of claim 2, wherein (A)(1) comprises:

(A)(1)(a) for each of the plurality of heat sink temperatures:

(i) providing the thermal print head with at least some of the plurality of input energies to print a plurality of output units having at least some of the plurality of printed densities; and (ii) measuring densities of the output units at an index N to identify the at least some of the plurality of printed densities.

4. The method of claim 3, wherein (A)(1)(a)(i) comprises providing the thermal print head with a plurality of constant input energies.

5. The method of claim 3, wherein (B) comprises identifying the sensitivity S(d) of the thermal print medium to the temperature of the plurality of print head elements based on the sensitivity $S_{eff}^{N}(d)$ of the thermal print medium to the temperature of the heat sink using the formula $$S(d) = \frac{S_{eff}^{N}(d)}{1 + T_{scale}^{N} S_{eff}^{N}(d)},$$

wherein d denotes density, and wherein $T_{scale}^{N}$ is a cumulative temperature relative to a heat sink temperature at output unit N for a constant unit energy applied to the print head.

6. The method of claim 2, wherein step (A)(1) comprises producing an estimate $\hat{S}_{eff}^{N}(d)$ of the sensitivity of the thermal print medium to the temperature of the heat sink using the formula:

$$\hat{S}_{eff}^{N}(d) = \frac{1}{P}\sum_{p} \frac{\Gamma_{Np}^{-1}(d) - \Gamma_{N}^{-1}(d)}{T_{sp} - T_{\Gamma s}},$$

wherein d denotes density, wherein P is the number of the plurality of heat sink temperatures, wherein p is an index into the plurality of heat sink temperatures, wherein $T_{sp}$ is a heat sink temperature at index p into the plurality of heat sink temperatures, wherein $\Gamma_{Np}^{-1}(\bullet)$ is an inverse gamma function for the thermal print head measured at output unit N and heat sink temperature $T_{sp}$, wherein $\Gamma_{N}^{-1}(\bullet)$ is an inverse gamma function for the thermal print head measured at output unit N, wherein $T_{\Gamma s}$ is a heat sink temperature for which the function $\Gamma_{N}^{-1}(\bullet)$ was measured, and wherein d denotes density.

7. The method of claim 1, further comprising:

(C) estimating parameters of a thermal model of the print head based on the sensitivity of the thermal print medium to the temperature of the plurality of print head elements.

8. The method of claim 7, wherein (C) comprises:

(C)(1) initializing the thermal model parameters; and (C)(2) iteratively optimizing the thermal model parameters by minimizing an error between predicted densities and measured densities of a test image printed by the thermal print head.

9. The method of claim 8, wherein (C)(2) comprises:

(C)(2)(a) applying the thermal model, with the initialized parameters, to a plurality of input energies to produce predicted temperatures of the plurality of print head elements; and (C)(2)(b) identifying the predicted densities based on the predicted temperatures of the plurality of print head elements and the sensitivity of the thermal print medium to the temperature of the plurality of print head elements.

10. The method of claim 9, wherein (C)(2)(b) comprises:

(C)(2)(b)(i) identifying the predicted densities d based on the equation $E=\Gamma^{-1}(d)+S(d)(T_a-T_{\Gamma a}(d))$,, wherein E denotes input energy, wherein $\Gamma(\bullet)$ is a gamma function of the thermal print head, wherein $S(\bullet)$ is the sensitivity of the thermal print medium to the temperature $T_a$ of the plurality of print head elements, and wherein $T_{\Gamma a}(d)$ is a temperature of the plurality of print head elements for density d under conditions for which the gamma function $\Gamma(\bullet)$ was measured.

11. An apparatus for use in conjunction with a thermal print head having a plurality of print head elements and an associated heat sink, the apparatus comprising:

effective sensitivity identification means for identifying a sensitivity of a thermal print medium to a temperature of the heat sink; and sensitivity identification means for identifying a sensitivity of the thermal print medium to a temperature of the plurality of print head elements based on the identified sensitivity of the thermal print medium to the temperature of the heat sink.

12. The apparatus of claim 11, wherein the effective sensitivity means comprises:

means for identifying the sensitivity of the thermal print medium to the heat sink temperature based on a plurality of printed densities produced by the thermal print head, a plurality of heat sink temperatures associated with the plurality of printed densities, and a plurality of input energies associated with the plurality of printed densities.

13. The apparatus of claim 12, wherein the effective sensitivity means comprises, for each of the plurality of heat sink temperatures:

means for providing the thermal print head with at least some of the plurality of input energies to print a plurality of output units having at least some of the plurality of printed densities; and means for measuring densities of the output units at an index N to identify the at least some of the plurality of printed densities.

14. The apparatus of claim 11, further comprising:

means for estimating parameters of a thermal model of the print head based on the sensitivity of the thermal print medium to the temperature of the plurality of print head elements.

15. A computer-implemented method for use in conjunction with a thermal print head having a plurality of print head elements and an associated heat sink, the method comprising:

(A) identifying a plurality of output units having a plurality of printed densities produced by the thermal print head on a thermal print medium;

(B) identifying a plurality of input energies associated with the plurality of printed densities;

(C) identifying a media model relating a first temperature of the plurality of print head elements and the plurality of input energies to the plurality of printed densities on the thermal print medium; and (D) identifying a second temperature of the plurality of print head elements based on the plurality of printed densities, the plurality of input energies, and the media model.

16. The method of claim 15, further comprising:

(E) identifying a thermal model relating the plurality of input energies to the first temperature of the plurality of thermal print head elements; and (F) estimating parameters of the thermal model based on the second temperature of the plurality of print head elements identified in (D).

17. The method of claim 15, further comprising:

(E) identifying the first temperature of the plurality of print head elements based on the thermal model and the plurality of input energies;

(F) minimizing an error between the first and second temperatures; and (G) estimating parameters of the thermal model based on the minimized error.

18. The method of claim 17, wherein (G) comprises estimating parameters $\alpha_l$ and $A_l$ of the thermal model, for $0\leqq l<L$, wherein L is positive, in accordance with the constraint $\alpha_l+S(d)A_l\geqq x_l$, wherein $x_l$ is non-negative for $0\leqq l<L$, wherein d is density, and wherein $S(\bullet)$ is a sensitivity function specifying a sensitivity of the thermal print medium to the first temperature of the plurality of print head elements.

19. The method of claim 15, wherein E(n) denotes the plurality of input energies provided to the thermal print head, and wherein (D) comprises:

(D)(1) identifying a gamma function $\Gamma_N(\bullet)$ of the print head corresponding to ones of the output units having index N;

(D)(2) identifying a temperature $T_{\Gamma s}$ at which the gamma function $\Gamma_N(\bullet)$ was measured;

(D)(3) identifying a sensitivity $S_{eff}^N(\bullet)$ of the thermal print medium to heat sink temperature;

(D)(4) identifying a cumulative temperature $T_{scale}^N$ relative to the heat sink temperature at index N of the plurality of output units; and (D)(5) identifying the second temperature $T_a(n)$ of the plurality of print head elements at indices n using the formula:

$$T_a(n) = T_{\Gamma s} + T_{scale}^N E(n) + \frac{E(n) - \Gamma_N^{-1}(d(n))}{S_{eff}^N(d(n))},$$

wherein d(n) denotes densities of ones of the output units at index n.

20. The method of claim 19, wherein (D)(4) comprises identifying the cumulative relative temperature $T_{scale}^N$ using the following formula:

$$T_{scale}^N = \frac{1}{M}\sum_{m=0}^{M-1}\left[\frac{T_s(m) - T_{\Gamma s}}{E_m(0)} + \frac{\Gamma_N^{-1}(\hat{d}_m(0))/E_m(0) - 1}{S_{eff}^N(\hat{d}_m(0))}\right],$$

wherein M denotes a number of the plurality of output units at line 0, wherein m denotes an index into the M output units, wherein $\hat{d}_m(0)$ denotes a density measured at line 0, wherein $E_m(0)$ denotes an energy provided at line 0, and wherein $T_s(m)$ denotes a heat sink temperature measured for sample m.

21. An apparatus for use in conjunction with a thermal print head having a plurality of print head elements and an associated heat sink, the apparatus comprising:

output unit identification means for identifying a plurality of output units having a plurality of printed densities produced by the thermal print head on a thermal print medium;

input energy identification means for identifying a plurality of input energies associated with the plurality of printed densities;

media model identification means for identifying a media model relating a first temperature of the plurality of print head elements and the plurality of input energies to the plurality of printed densities on the thermal print medium; and temperature identification means for identifying a second temperature of the plurality of print head elements based on the plurality of printed densities, the plurality of input energies, and the media model.

22. The apparatus of claim 21, further comprising:

thermal model identification means for identifying a thermal model relating the plurality of input energies to the first temperature of the plurality of thermal print head elements; and means for estimating parameters of the thermal model based on the second temperature of the plurality of print head elements.

23. The apparatus of claim 21, further comprising:

means for identifying the first temperature of the plurality of print head elements based on the thermal model and the plurality of input energies;

means for minimizing an error between the first and second temperatures; and means for estimating parameters of the thermal model based on the minimized error.

24. The apparatus of claim 21, wherein E(n) denotes the plurality of input energies provided to the thermal print head, and wherein the temperature identification means comprises:

means for identifying a gamma function $\Gamma_N(\bullet)$ of the print head corresponding to ones of the output units having index N;

means for identifying a temperature $T_{\Gamma s}$ at which the gamma function $\Gamma_N(\bullet)$ was measured;

means for identifying a sensitivity $S_{eff}^N(\bullet)$ of the thermal print medium to heat sink temperature;

means for identifying a cumulative temperature $T_{scale}^N$ relative to the heat sink temperature at index N of the plurality of output units; and means for identifying the second temperature $T_a(n)$ of the plurality of print head elements at indices n using the formula:

$$T_a(n) = T_{\Gamma s} + T_{scale}^N E(n) + \frac{E(n) - \Gamma_N^{-1}(d(n))}{S_{eff}^N(d(n))},$$

wherein d(n) denotes densities of ones of the output units at index n.

25. A computer-implemented method for use in conjunction with a thermal print head having an associated heat sink, the method comprising:

(A) identifying a media model relating temperature of a print head element in the thermal print head and input energy to printed density on a thermal print medium;

(B) selecting initial parameters of the media model;

(C) identifying a thermal model relating thermal print head input energy to thermal print head element temperature;

(D) selecting initial parameters of the thermal model;

(E) providing a plurality of input energies to the thermal print head based on the initial parameters of the media model and the initial parameters of the thermal model to produce a plurality of printed densities on the thermal print medium at a plurality of heat sink temperatures; and (F) refining the parameters of the media model and the parameters of the thermal model based on the plurality of input energies, the plurality of printed densities, and the plurality of heat sink temperatures, and the initial parameters of the media and thermal models.

26. The method of claim 25, wherein (E) comprises:

(E)(1) selecting a constant target density $d_0$;

(E)(2) selecting a heat sink temperature $T_{\Gamma s}$;

(E)(3) identifying an estimated gamma function $\hat{\Gamma}_N(\bullet)$ for the selected heat sink temperature $T_{\Gamma s}$ and an index N;

(E)(4) identifying an estimated sensitivity function $\hat{S}_{eff}^N(\bullet)$; and (E)(5) attempting to print the target density $d_0$ by providing the thermal print head with an input energy E that is based on the estimated gamma function $\hat{\Gamma}_N(\bullet)$ and the estimated sensitivity function $\hat{S}_{eff}^N(\bullet)$.

27. The method of claim 26, wherein (E)(5) comprises attempting to print the target density $d_0$ by providing the thermal print head with energies E(n) defined by the following formula:

$E(n)=\hat{\Gamma}_N^{-1}(d_0)+\hat{S}(d_0)(T_a(n)-T_{\Gamma a}(d_0))$, wherein $\hat{S}(\bullet)$ is an estimated sensitivity function which estimates a sensitivity of the thermal print medium to a temperature of a plurality of print head elements of the thermal print head, wherein $T_a(n)$ is the temperature of the plurality of print head elements at index n, and wherein $T_{\Gamma a}(\bullet)$ is a temperature of the plurality of print head elements for which the estimated gamma function $\hat{\Gamma}_N(\bullet)$ was estimated.

28. The method of claim 26, further comprising:

(E)(6) repeating step (E)(5) for a plurality of heat sink temperatures $T_{sp}$ indexed by p and a plurality of target densities $d_{mp}$ indexed by m, wherein $T_{s0}=T_{\Gamma s}$ is the heat sink temperature at which the gamma function $\hat{\Gamma}_N(\bullet)$ is measured;

(E)(7) measuring a density $d_{m0}(N)$ for an index N, wherein $d_{mp}(N)$ denotes densities measured at index N for heat sink temperature $T_{sp}$;

(E)(8) obtaining an updated gamma function $\Gamma_N(\bullet)$ based on the formula $d_{m0}(N)=\Gamma_N(\hat{\Gamma}_N^{-1}(d_{m0}))$; and (E)(9) obtaining an updated sensitivity function $S_{eff}^N(\bullet)$ based on the formula:

$$S_{eff}^N(d_{mp}(N)) = \hat{S}_{eff}^N(d_{mp}) - \frac{\Gamma_N^{-1}(d_{mp}(N)) - \hat{\Gamma}_N^{-1}(d_{mp})}{T_{sp} - T_{\Gamma s}},\ p \neq 0.$$

29. An apparatus for use in conjunction with a thermal print head having an associated heat sink, the apparatus comprising:

media model identification means for identifying a media model relating temperature of a print head element in the thermal print head and input energy to printed density on a thermal print medium;

means for selecting initial parameters of the media model;

thermal model identification means for identifying a thermal model relating thermal print head input energy to thermal print head element temperature;

means for selecting initial parameters of the thermal model;

input energy provision means for providing a plurality of input energies to the thermal print head based on the initial parameters of the media model and the initial parameters of the thermal model to produce a plurality of printed densities on the thermal print medium at a plurality of heat sink temperatures; and parameter refinement means for refining the parameters of the media model and the parameters of the thermal model based on the plurality of input energies, the plurality of printed densities, and the plurality of heat sink temperatures, and the initial parameters of the media and thermal models.

30. The apparatus of claim 29, wherein the input energy provision means comprises:

means for selecting a constant target density $d_0$;

means for selecting a heat sink temperature $T_{\Gamma s}$;

means for identifying an estimated gamma function $\hat{\Gamma}_N(\bullet)$ for the selected heat sink temperature $T_{\Gamma s}$ and an index N;

means for identifying an estimated sensitivity function $\hat{S}_{eff}^{N}(\bullet)$; and means for attempting to print the target density $d_0$ by providing the thermal print head with an input energy E that is based on the estimated gamma function $\hat{\Gamma}_N(\bullet)$ and the estimated sensitivity function $\hat{S}_{eff}^{N}(\bullet)$.

31. A computer-implemented method for use in conjunction with a thermal print head having a plurality of print head elements and an associated heat sink, the method comprising:

(A) identifying a thermal model relating thermal print head input energy to thermal print head element temperature, the thermal model being characterized by a plurality of layers indexed by l, wherein L is the number of the plurality of layers, and wherein the thermal model is characterized by the following equation:

$$T^{(l)}(n)=T^{(l)}(n-1)\alpha_l+A_lE^{(l)}(n-1),\ l=0,\ldots,L-1,$$

wherein $E^{(l)}$ denotes an input energy applied to layer l, wherein $T^{(l)}$ denotes a temperature of layer l relative to layer l+1; and (B) selecting values of $\alpha_l$ and $A_l$ for $0 \leqq l < L$ in accordance with the following constraint: $\alpha_l+S(d)A_l \geqq x_l$, wherein $x_l$ is non-negative for $0 \leqq l < L$, wherein d is density, and wherein S(•) is a sensitivity function specifying a sensitivity of the thermal print medium to a temperature of the plurality of print head elements.

32. The method of claim 31, wherein $x_l=0$ for $0 \leqq l < L$.

33. The method of claim 31, wherein $$x_l = \frac{S^2(d)A_lA_k}{|\alpha'_l - \alpha'_k|}$$

for $k \neq l$, and wherein $\alpha'_l=\alpha_l+A_lS(d_0)$.

34. An apparatus for use in conjunction with a thermal print head having a plurality of print head elements and an associated heat sink, the apparatus comprising:

thermal model identification means for identifying a thermal model relating thermal print head input energy to thermal print head element temperature, the thermal model being characterized by a plurality of layers indexed by l, wherein L is the number of the plurality of layers, and wherein the thermal model is characterized by the following equation:

$$T^{(l)}(n)=T^{(l)}(n-1)\alpha_l+A_lE^{(l)}(n-1),\ l=0,\ldots,L-1,$$

wherein $E^{(l)}$ denotes an input energy applied to layer l, wherein $T^{(l)}$ denotes a temperature of layer l relative to layer l+1; and parameter selection means for selecting values of $\alpha_l$ and $A_l$ for $0 \leqq l < L$ in accordance with the following constraint: $\alpha_l+S(d)A_l \geqq x_l$, wherein $x_l$ is non-negative for $0 \leqq l < L$, wherein d is density, and wherein S(•) is a sensitivity function specifying a sensitivity of the thermal print medium to a temperature of the plurality of print head elements.

35. The apparatus of claim 34, wherein $x_l=0$ for $0 \leqq l < L$.

36. The apparatus of claim 34, wherein $$x_l = \frac{S^2(d)A_lA_k}{|\alpha'_l - \alpha'_k|}$$

for $k \neq l$, and wherein $\alpha'_l=\alpha_l+A_lS(d_0)$.

* * * * *